US010857784B2

(12) United States Patent
Honda et al.

(10) Patent No.: US 10,857,784 B2
(45) Date of Patent: Dec. 8, 2020

(54) PRINTING METHOD AND PRINTING APPARATUS

(71) Applicant: CANON KABUSHIKI KAISHA, Tokyo (JP)

(72) Inventors: Yoshiyuki Honda, Yokohama (JP); Atsushi Sakamoto, Yokohama (JP); Satoshi Masuda, Yokohama (JP); Toru Yamane, Yokohama (JP); Kyosuke Deguchi, Yokohama (JP); Ryosuke Hirokawa, Kawasaki (JP); Toru Ohnishi, Yokohama (JP); Akihiro Mouri, Fuchu (JP); Noboru Toyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 77 days.

(21) Appl. No.: 16/022,169

(22) Filed: Jun. 28, 2018

(65) Prior Publication Data

US 2018/0304616 A1 Oct. 25, 2018

Related U.S. Application Data

(63) Continuation of application No. PCT/JP2016/005249, filed on Dec. 28, 2016.

(30) Foreign Application Priority Data

Jan. 5, 2016 (JP) ..... 2016-000746
Jan. 29, 2016 (JP) ..... 2016-016269
May 27, 2016 (JP) ..... 2016-106189

(51) Int. Cl.
*B41J 2/005* (2006.01)
*B41J 2/01* (2006.01)
(Continued)

(52) U.S. Cl.
CPC ..... *B41J 2/0057* (2013.01); *B41J 2/01* (2013.01); *B41J 11/007* (2013.01);
(Continued)

(58) Field of Classification Search
CPC .... B41J 2/0057; B41J 11/0015; B41J 11/007; B41J 29/17; B41J 2/01; B41M 5/0017; B41M 7/00
See application file for complete search history.

(56) References Cited

U.S. PATENT DOCUMENTS 5,841,456 A 11/1998 Takei et al.
6,916,081 B2 7/2005 Nakashima
(Continued)

FOREIGN PATENT DOCUMENTS

CN 1990241 A 7/2007
CN 101332708 A 12/2008
(Continued)

OTHER PUBLICATIONS

First Office Action in Chinese Application No. 201680078028.4 (dated Apr. 28, 2019).
(Continued)

*Primary Examiner* — Henok D Legesse
(74) *Attorney, Agent, or Firm* — Venable LLP

(57) ABSTRACT

Reaction liquid application S1 to an ink receiving medium, formation of a first image by ink application S2, liquid absorption S3 from the first image by a porous body of a liquid absorbing member, cleaning S4 of the porous body, and liquid collection S5 from the porous body are repeated in an inkjet printing method. When the porous body comes into contact with the first image, first chemical species in the reaction liquid contributing to increasing the ink viscosity is contained, on the ink receiving medium and in the porous body, at a higher level in terms of molar equivalent per unit
(Continued)

area than second chemical species in the ink also contributing to increasing the ink viscosity. In the liquid collection S5, the liquid is collected so that the liquid remains in the porous body on the side to be brought into contact with the first image.

22 Claims, 11 Drawing Sheets

(51) Int. Cl.
*B41M 5/00* (2006.01)
*B41M 7/00* (2006.01)
*B41J 11/00* (2006.01)
*B41J 29/17* (2006.01)

(52) U.S. Cl.
CPC ..... *B41J 11/0015* (2013.01); *B41J 29/17* (2013.01); *B41M 5/0017* (2013.01); *B41M 7/00* (2013.01)

(56) References Cited

U.S. PATENT DOCUMENTS

| | | | | |
|---|---|---|---|---|
| 7,129,284 | B2 | 10/2006 | Ma et al. | |
| 7,422,318 | B2 | 9/2008 | Kadomatsu et al. | |
| 7,481,526 | B2 | 1/2009 | Inoue | |
| 7,497,564 | B2 | 3/2009 | Yui | |
| 7,556,342 | B2 | 7/2009 | Hamano | |
| 7,594,722 | B2 | 9/2009 | Kadomatsu et al. | |
| 7,766,457 | B2 | 8/2010 | Chen | |
| 7,845,760 | B2 | 12/2010 | Hirakawa | |
| 7,926,933 | B2 | 4/2011 | Taniuchi et al. | |
| 8,226,225 | B2 | 7/2012 | Yamanobe | |
| 8,246,158 | B2 | 8/2012 | Ageishi et al. | |
| 8,857,962 | B2 | 10/2014 | Goto et al. | |
| 9,102,137 | B2 | 8/2015 | Koitabashi et al. | |
| 9,616,653 | B2 | 4/2017 | Liu | |
| 9,796,171 | B2 | 10/2017 | Liu | |
| 9,821,584 | B2 | 11/2017 | Noguchi et al. | |
| 10,029,481 | B2 | 7/2018 | Ohnishi et al. | |
| 2005/0212884 | A1* | 9/2005 | Ueki | B41J 11/0015 347/105 |
| 2006/0055755 | A1 | 3/2006 | Yui et al. | |
| 2006/0061642 | A1 | 3/2006 | Ueki | |
| 2006/0170752 | A1 | 8/2006 | Kadomatsu et al. | |
| 2006/0221166 | A1 | 10/2006 | Inoue | |
| 2007/0229586 | A1 | 10/2007 | Hirakawa | |
| 2008/0055356 | A1 | 3/2008 | Yamanobe | |
| 2008/0236480 | A1 | 10/2008 | Furukawa et al. | |
| 2009/0079784 | A1 | 3/2009 | Chiwata et al. | |
| 2009/0317555 | A1* | 12/2009 | Hori | B41J 2/0057 427/428.06 |
| 2011/0069109 | A1 | 3/2011 | Tojo | |
| 2011/0310140 | A1* | 12/2011 | Tonohiro | B41J 11/0015 347/6 |
| 2015/0306539 | A1 | 10/2015 | Yamato | |
| 2018/0297377 | A1 | 10/2018 | Ohnishi et al. | |
| 2018/0304617 | A1 | 10/2018 | Ohnishi et al. | |
| 2018/0311951 | A1 | 11/2018 | Sakamoto et al. | |
| 2018/0319166 | A1 | 11/2018 | Yamane et al. | |
| 2018/0319179 | A1 | 11/2018 | Yamane et al. | |
| 2018/0319188 | A1 | 11/2018 | Toyama et al. | |
| 2018/0319189 | A1 | 11/2018 | Ohnishi et al. | |
| 2018/0319190 | A1 | 11/2018 | Hirokawa et al. | |
| 2018/0326719 | A1 | 11/2018 | Masuda et al. | |
| 2018/0326755 | A1 | 11/2018 | Ohnishi et al. | |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| EP | 2 123 459 | A2 | 11/2009 |
| EP | 2 777 941 | A1 | 9/2014 |
| JP | 2000-103157 | A | 4/2000 |
| JP | 2001-171143 | A | 6/2001 |
| JP | 2001-179959 | A | 7/2001 |
| JP | 2004-43047 | A | 2/2004 |
| JP | 2004-181955 | A | 7/2004 |
| JP | 2005-161610 | A | 6/2005 |
| JP | 2006-82428 | A | 3/2006 |
| JP | 2006-88486 | A | 4/2006 |
| JP | 2006-102981 | A | 4/2006 |
| JP | 2006-205677 | A | 8/2006 |
| JP | 2006-264080 | A | 10/2006 |
| JP | 2007-268974 | A | 10/2007 |
| JP | 2007-268975 | A | 10/2007 |
| JP | 4016559 | B2 | 12/2007 |
| JP | 2008-55852 | A | 3/2008 |
| JP | 2008-087283 | A | 4/2008 |
| JP | 2008-213333 | A | 9/2008 |
| JP | 2008-246787 | A | 10/2008 |
| JP | 2009-000915 | A | 1/2009 |
| JP | 2009-000916 | A | 1/2009 |
| JP | 2009-045851 | A | 3/2009 |
| JP | 2009-61644 | A | 3/2009 |
| JP | 2009-086348 | A | 4/2009 |
| JP | 2009-159116 | A | 7/2009 |
| JP | 2009-166387 | A | 7/2009 |
| JP | 2009-214439 | A | 9/2009 |
| JP | 2009-226852 | A | 10/2009 |
| JP | 2009-234219 | A | 10/2009 |
| JP | 2010-201796 | A | 9/2010 |
| JP | 2011-63001 | A | 3/2011 |
| JP | 2011-245865 | A | 12/2011 |
| JP | 2012-116617 | A | 6/2012 |
| JP | 2012-183798 | A | 9/2012 |
| JP | 2013-10267 | A | 1/2013 |
| JP | 2014-193599 | A | 10/2014 |
| JP | 2015-16687 | A | 1/2015 |
| JP | 2015-96562 | A | 5/2015 |
| JP | 2015-098097 | A | 5/2015 |
| JP | 2015-145117 | A | 8/2015 |
| JP | 2015-150789 | A | 8/2015 |
| JP | 2015-208881 | A | 11/2015 |
| JP | 2016-120625 | A | 7/2016 |
| KE | 2009-072927 | A | 4/2009 |
| WO | 2015/034027 | A1 | 3/2015 |
| WO | 2017/119044 | A1 | 7/2017 |
| WO | 2017/119045 | A1 | 7/2017 |
| WO | 2017/119046 | A1 | 7/2017 |
| WO | 2017/119047 | A1 | 7/2017 |
| WO | 2017/119048 | A1 | 7/2017 |
| WO | 2017/119049 | A1 | 7/2017 |
| WO | 2018/105215 | A1 | 6/2018 |

OTHER PUBLICATIONS

First Office Action in Chinese Application No. 201680078027.X (dated Apr. 25, 2019).
First Office Action in Chinese Application No. 201680078100.3 (dated Apr. 25, 2019).
International Preliminary Report on Patentability in International Application No. PCT/JP2016/005249 (dated Jul. 2018).
Ohnishi et al., U.S. Appl. No. 16/022,223, filed Jun. 28, 2018.
Toyama et al., U.S. Appl. No. 16/022,118, filed Jun. 28, 2018.
Yamane et al., U.S. Appl. No. 16/022,143, filed Jun. 28, 2018.
Ohnishi et al., U.S. Appl. No. 16/018,182, filed Jun. 26, 2018.
Ohnishi et al., U.S. Appl. No. 16/022,189, filed Jun. 28, 2018.
Ohnishi et al., U.S. Appl. No. 16/013,276, filed Jun. 20, 2018.
Sakamoto et al., U.S. Appl. No. 16/026,202, filed Jul. 3, 2018.
Torisaka et al., U.S. Appl. No. 16/019,905, filed Jun. 27, 2018.
Extended European Search Report in European Application No. 16883554.4 (dated Jul. 11, 2019).
Extended European Search Report in European Application No. 16883550.2 (dated Jul. 12, 2019).
Extended European Search Report in European Application No. 16883551.0 (dated Jul. 12, 2019).
Extended European Search Report in European Application No. 16883553.6 (dated Jul. 12, 2019).

(56) References Cited

OTHER PUBLICATIONS

Machine translation of JP 2008-213333 (Sep. 18, 2008).
Machine translation of JP 2009-061644 (Mar. 26, 2009).
Machine translation of 2015-098097 (May 28, 2015).
Machine translation of 2015-145117 (Aug. 13, 2015).
First Office Action in Chinese Application No. 201680078084.8 (dated May 24, 2019).
Search Report and Written Opinion in Singapore Application No. 11201805829P (dated Sep. 17, 2018).
International Search Report in International Application No. PCT/JP2016/005249 (dated Mar. 2017).
Extended European Search Report in European Application No. 16883546.0 (dated Jul. 23, 2019).
Extended European Search Report in European Application No. 16883549.4 (dated Jul. 23, 2019).
Second Office Action in Chinese Application No. 201680078028.4 (dated Jun. 2, 2020).

* cited by examiner

PRINTING METHOD AND PRINTING APPARATUS

CROSS-REFERENCE TO RELATED APPLICATIONS

This application is a continuation of International Application No. PCT/JP2016/005249, filed Dec. 28, 2016, which claims the benefit of Japanese Patent Application No. 2016-000746, filed Jan. 5, 2016, Japanese Patent Application No. 2016-016269, filed Jan. 29, 2016, and Japanese Patent Application No. 2016-106189, filed May 27, 2016, all of which are hereby incorporated by reference herein their entirety.

BACKGROUND OF THE INVENTION

Field of the Invention

The present invention relates to a printing method and a printing apparatus.

Description of the Related Art

In the ink jet printing method, an image is formed by directly or indirectly applying a liquid composition (ink) containing a coloring material to a printing medium such as paper. In this process, the printing medium may cause curl or cockling due to excessive absorption of a liquid component in the ink.

Thus, to quickly remove the liquid component in the ink, there is a method of drying the printing medium using a means such as warm air or infrared light. There is also a method in which an image is formed on a transfer body, subsequently, a liquid component contained in the image on the transfer body is dried by thermal energy or the like, and then the image is transferred onto a printing medium such as paper.

In addition, as a means to remove the liquid component contained in an image on the transfer body, there has been proposed a method including, instead of using thermal energy, bringing a roller-shaped porous body into contact with an ink image and absorbing and removing the liquid component from the ink image (Japanese Patent Application Laid-Open No. 2009-45851). Also, Japanese Patent Application Laid-Open No. 2009-45851 describes a configuration in which treatment liquid having a function of aggregating a solvent-insoluble component (such as a coloring material) in the ink is applied onto a transfer body by a treatment liquid applying unit, for instance, an application roller, and subsequently, the ink is applied to the transfer body.

Furthermore, provision of a mechanism for collecting the liquid absorbed in an absorbing body has been proposed. Japanese Patent Application Laid-Open No. 2001-179959 proposes a method in which a mechanism for squeezing out the liquid absorbed in an absorbing body is provided. Japanese Patent Application Laid-Open No. 2007-268975 proposes a configuration provided with a liquid collecting unit for sucking and collecting the liquid absorbed in a liquid absorbing member.

When a liquid component is absorbed from an ink image using a porous body, part of solid components, such as coloring materials and resin particles, contained in the ink image may be taken in not only the surface of the porous body, but also the inside of the porous body. The pores of the porous body are occluded and clogged by the solid components intruding into the porous body, and the porous body is lowered in the performance as an absorbing member, and cannot maintain the function as means for removing the liquid component. In order to recover the performance of the porous body, an approach of removing the solid components causing clogging may be considered. When the solid components intruding into the inside of the porous body are attempted to be removed by the sucking and collecting method as in Japanese Patent Application Laid-Open No. 2007-268975, deterioration of the porous body is inevitable. In order to solve this problem, Japanese Patent Application Laid-Open No. 2007-268975 proposes an approach of preventing a coloring material and the like from intruding into the pores of the porous body by providing a difference in surface energy between the surface and the inside of a solvent absorbing roller (sixth embodiment). Specifically, surface energy $\gamma 2$ of the inside of the porous body is made smaller than surface energy $\gamma 1$ of the surface of the porous body. However, since the liquid absorbing capability (capillary force) of the porous body is reduced, this method has difficulty in quickly absorbing the liquid in an ink image, and is not effective sufficiently for high-speed printing. When high-speed printing is aimed using this method, the contact pressure of the porous body with the ink image needs to be increased so as to push the liquid in the ink image into the inside of the porous body. However, in this case, the solid components such as a coloring material may intrude into the porous body.

Thus, it is an object of the present invention to provide an ink jet printing method that can reduce the intrusion of ink solid component into a porous body during liquid absorption, and allows the porous body to maintain the performance and improve the durability.

SUMMARY OF THE INVENTION

In order to solve the above-mentioned problem, an ink jet printing method according to an embodiment of the present invention includes:

(1) a step of applying a reaction liquid to an ink receiving medium, the reaction liquid containing an ink viscosity-increasing component that increases a viscosity of an ink;

(2) a step of forming a first image by applying the ink to the ink receiving medium with the reaction liquid applied thereto;

(3) a liquid absorbing step of bringing a liquid absorbing member having a porous body into contact with the first image, and absorbing liquid from the first image by the porous body;

(4) a step of bringing a cleaning member into contact with a first surface of the porous body, to be brought into contact with the first image, and cleaning the first surface; and (5) a liquid collecting step of collecting the liquid absorbed by the porous body.

On the ink receiving medium and in the porous body in an event where the porous body is brought into contact with the first image, a first chemical species contributing to a reaction of the ink viscosity-increasing component is contained at a higher level in terms of molar equivalent per unit area than a second chemical species in the ink, which reacts with the ink viscosity-increasing component, and in the liquid collecting step, the liquid is collected so that the liquid remains on the first surface side of the porous body.

Further features of the present invention will become apparent from the following description of exemplary embodiments with reference to the attached drawings.

DESCRIPTION OF THE EMBODIMENTS

Figure 1:
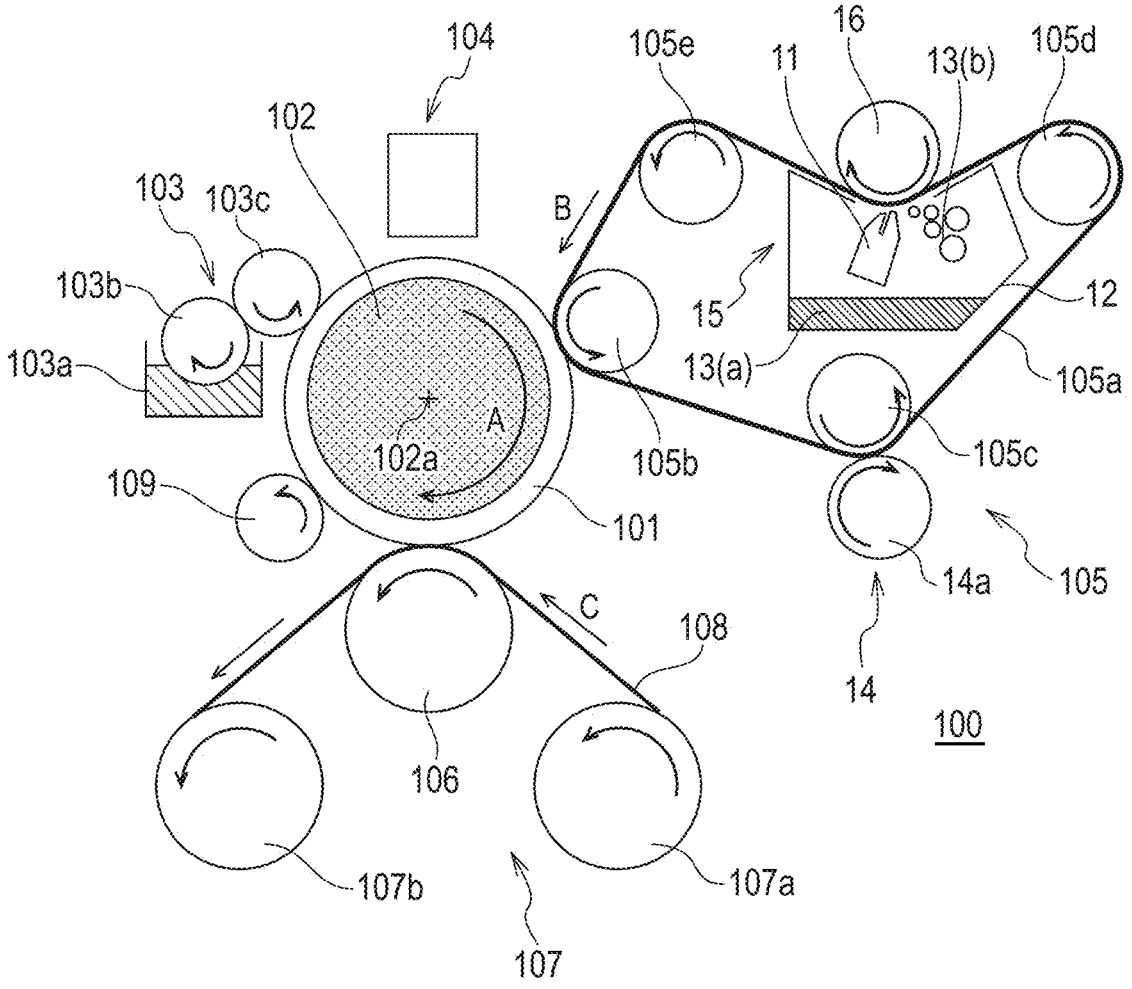
FIG. 1 is a schematic view illustrating an example of a configuration of a transfer type ink jet printing apparatus in an embodiment of the present invention.

Preferred embodiments of the present invention will now be described in detail in accordance with the accompanying drawings.

Hereinafter, the present invention will be described via detailed illustration of a preferred embodiment.

An ink jet printing method in an embodiment of the present invention includes:

(1) a step of applying reaction liquid to an ink receiving medium, the reaction liquid containing an ink viscosity-increasing component that increases a viscosity of an ink;

(2) a step of forming a first image by applying the ink to the ink receiving medium with the reaction liquid applied thereto;

(3) a liquid absorbing step of bringing a liquid absorbing member having a porous body into contact with the first image, and absorbing liquid from the first image by the porous body;

(4) a step of bringing a cleaning member into contact with a first surface of the porous body, to be in contact with the first image, and cleaning the first surface; and (5) a liquid collecting step of collecting the liquid absorbed by the porous body.

The cycle of at least steps (1) to (4) is repeated, and the step (5) is performed multiple times less than or equal to the number of repetitions of the cycle of steps (1) to (4). On the ink receiving medium and in the porous body in an event where the porous body is brought into contact with the first image, more first chemical species contributing to reaction of the ink viscosity-increasing component are contained in terms of a molar equivalent per unit area than second chemical species in the ink which react with the ink viscosity-increasing component. In the liquid collecting step, the liquid is collected so that the liquid remains on a side of the first surface of the porous body.

Here, the first image refers to an ink image before liquid removal, before undergoing the later-described liquid absorption treatment, and the second image refers to an ink image after liquid removal, which has undergone the liquid absorption treatment and has a reduced content of an aqueous liquid component.

<Reaction Liquid Application Step (1)>

For reaction liquid application, any device capable of applying reaction liquid onto an ink receiving medium may be used, and conventionally known various devices may be used as needed. Specifically, a gravure offset roller, an inkjet head, a die coating device (die coater), and a blade coating device (blade coater) may be used. Particularly, the device is preferably capable of applying reaction liquid uniformly onto the entire region on an ink receiving medium to which an ink is applicable by the later-described ink applying device. Applying reaction liquid before application of the ink can suppress bleeding in which adjacently applied inks are mixed, and beading in which a previously landed ink is attracted to subsequently landed ink during image printing by an inkjet system.

<Reaction Liquid>

The reaction liquid contains a component (ink viscosity-increasing component) that causes an increase in the viscosity of an ink. The increase in the viscosity of an ink refers to a phenomenon in which a coloring material and a resin, which are part of components contained in an ink, come into contact with an ink viscosity-increasing component resulting in chemical reaction or physical adsorption, and thereby an ink viscosity increase is recognized. The increase in the viscosity of an ink includes not only the case where a clay viscosity increase is recognized, but also the case where part of the components contained in the ink, such as a coloring material, aggregates, thereby locally increasing the viscosity. The ink viscosity-increasing component has an effect of reducing the fluidity of an ink and/or part of the components included in an ink on an ink receiving medium and of inhibiting bleeding and beading during formation of the first image. In the present invention, increasing in the viscosity of an ink is also referred to as "viscously thickening an ink". As such ink viscosity-increasing component, a publicly known component, such as a multi-charged metal ion, an organic acid, a cationic polymer, and porous particles, may be used. Among all, particularly, a multi-charged metal ion and an organic acid are preferred. Also, it is preferable that multiple types of ink viscosity-increasing component be contained. It is preferable that the content of ink viscosity-increasing component in the reaction liquid be 5% by mass or greater with respect to the total mass of reaction liquid.

The multi-charged metal ion includes, for instance, a divalent metal ion such as $Ca^{2+}$, $Cu^{2+}$, $Ni^{2+}$, $Mg^{2+}$, $Sr^{2+}$, $Ba^{2+}$, and and $Zn^{2+}$, and a trivalent metal ion such as $Fe^{3+}$, $Cr^{3+}$, $Y^{3+}$, and $Al^{3+}$.

Also, the organic acid includes, for instance, oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, piron carboxylic acid, pyrrole carboxylic acid, furancarboxylic acid, pyridinecarboxylic acid, coumarin acid, thiophenecarboxylic acid, nicotinic acid, hydroxysuccinic acid, and dioxy-succinic acid.

The reaction liquid may contain a proper amount of an organic solvent with a low volatility. The water to be used in this case is preferably deionized water produced by ion exchange. Also, an organic solvent, which may be used for the reaction liquid applied to the present embodiment, is not particularly limited, and a publicly known organic solvent may be used.

Furthermore, the reaction liquid may be used with adjusted surface tension and viscosity as needed by adding a surface-active agent and/or a viscosity modifying agent to the reaction liquid. A material used is not particularly restricted as long as the material can coexist with the ink viscosity-increasing component. The surface-active agent specifically used includes a fluorochemical surface-active agent of an acetylene glycol ethylene oxide adduct (product name "Acetyrenol E100" manufactured by Kawaken Fine Chemicals Co., Ltd), and a perfluoroalkyl ethylene oxide adduct (product name "Megafac F444" manufactured by DIC Corporation).

In the present embodiment, in order to improve the cleaning performance of a liquid absorbing member, the liquid absorbed from the first image by a porous body having a liquid absorbing member contains an ink viscosity-increasing component contained in reaction liquid. In order to achieve this state, a reaction liquid application apparatus 104 applies reaction liquid in an amount more than necessary to increase the viscosity of a maximum amount of the ink to be applied subsequently. Since the liquid component absorbed from the image contains the ink viscosity-increasing component in the reaction liquid, the porous body of the liquid absorbing member contains chemical species of the ink viscosity-increasing component which are yet to react with chemical species in the ink which contribute to an increase in the viscosity. The chemical species in the reaction liquid contributing to an increase in the viscosity is referred to as a first chemical species, and the chemical species in the ink contributing to an increase in the viscosity is referred to as a second chemical species. As mentioned above, the first chemical species include multi-charged metal ions, and cationic components such as proton ions or hydronium ions generated from organic acid. The second chemical species in an ink include anionic components that react with cationic components of the first chemical species, and include acid anions such as carboxylic acid anion, sulfonate anion, phosphate anion.

It is to be noted that the amount of applied reaction liquid may be such an application amount that allows a substantially uniform layer to be formed when reaction liquid is applied to the entire region on an ink receiving medium to which an ink is applicable by an ink applying device. Thus, reduction in the circularity of an ink dot can be decreased. Also, excessive application of reaction liquid may contract in a process of aggregating ink solid component, and the image quality may be impaired. From such a viewpoint, the amount of applied reaction liquid in the present embodiment is preferably 0.05 $g/m^2$ or greater and 2 $g/m^2$ or less, and is more preferably 0.1 $g/m^2$ or greater and 1.3 $g/m^2$ or less.

<Ink Applying Step (2)>

An inkjet head is used as the ink applying device that applies an ink. The inkjet head has, for instance, a form of discharging an ink by causing film boiling in the ink to form air bubbles by an electric-heat conversion body, a form of discharging an ink by an electric-machine conversion body, and a form of discharging an ink by utilizing static electricity. A publicly known inkjet head may be used in the present embodiment. Among all, particularly, from the viewpoint of high speed and high-density printing, an inkjet head utilizing an electric-heat conversion body is preferably used. For drawing, an image signal is received, and a necessary amount of ink is applied to each position.

Although the amount of applied ink may be expressed in terms of an image concentration (duty) or an ink thickness, in the present embodiment, the amount of applied ink ($g/m^2$) is given by an average value obtained by dividing the product of the mass of each ink dot and the number of application by a printing area. It is to be noted that a maximum amount of applied ink in an image region indicates the amount of ink applied to an area of at least 5 $mm^2$ in an region used as information on the ink receiving medium from the viewpoint of removing the liquid component in the ink.

The ink jet printing apparatus of the present embodiment may have multiple inkjet heads in order to apply the ink of each color onto the ink receiving medium. For instance, when each color image is formed using yellow ink, magenta ink, cyan ink, and black ink, the ink jet printing apparatus has four inkjet heads that discharge the above-mentioned respective four types of ink onto the ink receiving medium.

Also, an ink applying member may include an inkjet head that discharges an ink (clear ink) not containing a coloring material.

<Ink>

The components of the ink applied to the present embodiment will be described.

(Coloring Material)

Pigment or a mixture of dye and pigment may be used as the coloring material contained in the ink applied to the present embodiment.

The type of pigment which may be used as the coloring material is not particularly limited. The specific examples of pigment include an inorganic pigment such as carbon black; and an organic pigment such as azo-based, phthalocyanine-based, quinacridone-based, isoindolinone-based, imidazolone-based, diketo-pyrrolo-pyrrole-based, and dioxazine-based pigments. One type or two or more types of these pigments may be used as necessary.

The type of dye which may be used as the coloring material is not particularly limited. The specific examples of dye include a direct dye, an acid dye, a basic dye, a disperse dye, and an edible dye, and a dye having an anionic group may be used. The specific examples of dye skeleton include an azo skeleton, a triphenylmethane skeleton, a phthalocyanine skeleton, an azaphthalocyanine skeleton, a xanthene skeleton, and an anthrapyridone skeleton.

The content of pigment in the ink is preferably 0.5% by mass or greater and 15.0% by mass or less with respect to the total mass of the ink, and is more preferably 1.0% by mass or greater and 10.0% by mass or less.

(Dispersing Agent)

A publicly known dispersing agent used for the ink for inkjet may be used as the dispersing agent for dispersing pigments. Among all, in an aspect of the present embodiment, a water-soluble dispersing agent having both a hydrophilic moiety and a hydrophobic moiety is preferably used. Particularly, a pigment dispersing agent composed of a copolymerized resin including at least a hydrophilic monomer and a hydrophobic monomer is preferably used. Each monomer used here is not particularly restricted, and a publicly known monomer is preferably used. Specifically, the hydrophobic monomer includes styrene and other styrene derivatives, alkyl (meth) acrylate, and benzyl (meth)

acrylate. Also, the hydrophilic monomer includes acrylic acid, methacrylic acid, and maleic acid.

The acid value of the dispersing agent is preferably 50 mgKOH/g or greater and 550 mgKOH/g or less. Also, the weight average molecular weight of the dispersing agent is preferably 1000 or greater and 50000 or less. The mass ratio (pigment: dispersing agent) of pigment to dispersing agent is preferably in the range of 1:0.1 to 1:3.

Also, the pigment itself having a modified surface to allow dispersion without using a dispersing agent, so-called a self-dispersed pigment is preferably used.

(Resin Fine Particles)

The ink applied to the present embodiment may be used with various particles having no coloring material contained. Among all, resin particles may have an effect on improving the image quality and the fixation, and thus are also preferred.

The material of resin particles which may be used for the present embodiment is not particularly limited, and a publicly known resin may be used as needed. Specifically, the material includes polyolefin, polystyrene, polyurethane, polyester, polyether, polyurea, polyamide, polyvinyl alcohol, poly (meth) acrylic acid and its base, poly (meta) alkyl acrylate, single polymers such as polydiene, and copolymer polymerized by combining multiple monomers for generating these single polymers. The weight average molecular weight (Mw) of the resin is preferably in the range of 1,000 or greater and 2,000,000 or less. Also, the amount of the resin particles in the ink is preferably 1% by mass or greater and 50% by mass or less with respect to the total mass of the ink, and is more preferably 2% by mass or greater and 40% by mass or less.

Furthermore, in an aspect of the present embodiment, the ink is preferably used as a resin particle dispersion in which resin particles are dispersed in the liquid. Although the technique for dispersion is not particularly limited, a dispersing element using a resin in which monomers having a dissociable group are homopolymerized or multiply copolymerized, so-called a self-dispersed resin particle dispersion is preferred. Here, the dissociable group includes a carboxyl group, a sulfonic group, and a phosphate group, and the monomer having the dissociable group includes acrylic acid and methacrylic acid. Also, a dispersing element in which resin particles are dispersed by an emulsifier, so-called an emulsifier dispersed resin particle dispersion may also be preferably used in the present embodiment similarly. Regardless of low molecular weight or high molecular weight, a publicly known surface-active agent is preferable as the emulsifier mentioned here. The surface-active agent is preferably a non-ionic surface-active agent or a surface-active agent having the same charge as the resin particles. The resin particle dispersion used in an aspect of the present embodiment preferably has a dispersion particle diameter of 10 nm or greater and 1000 nm or less, more preferably has a dispersion particle diameter of 100 nm or greater and 500 nm or less.

Also, when a resin particle dispersion used in an aspect of the present embodiment is produced, it is also preferable to add various additive agents for stabilization. The additive agents include, for instance, n-hexadecane, dodecyl methacrylate, stearyl methacrylate, chlorobenzene, dodecylmercaptan, blue dye (bluing agent), and polymethylmethacrylate.

(Surface-Active Agent)

The ink which can be used for the present embodiment may contain a surface-active agent. Specifically, an acetylene glycol ethylene oxide adduct (product name "Acetyrenol E100" manufactured by Kawaken Fine Chemicals Co., Ltd) may be used as the surface-active agent. The amount of surface-active agent in the ink is preferably 0.01% by mass or greater and 5.0% by mass or less with respect to the total mass of the ink.

(Water and Water-Soluble Organic Solvent)

The ink used in the embodiment may contain water and/or water soluble organic solvent as the solvent. The water is preferably deionized water produced by ion exchange or the like. Also, the content of water in the ink is preferably 30% by mass or greater and 97% by mass or less with respect to the total mass of the ink, and is more preferably 50% by mass or greater and 95% by mass or less with respect to the total mass of the ink.

Also, the type of water-soluble organic solvent to be used is not particularly limited, and any publicly known organic solvent may be used. Specifically, the type of water-soluble organic solvent includes glycerin, diethylene glycol, polyethylene glycols, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Needless to say, two or more types selected from these may be mixed and used. Also, the content of water-soluble organic solvent in the ink is preferably 3% by mass or greater and 70% by mass or less with respect to the total mass of the ink.

(Other Additive Agents)

The ink which may be used for the present embodiment may contain various additive agents other than the above-mentioned components as necessary, such as a pH adjuster, an anticorrosive agent, an antiseptic agent, an antifungal agent, an antioxidizing agent, an antireduction agent, a water-soluble resin and its neutralizer, and a viscosity modifying agent.

<Liquid Absorbing Step (3)>

In the embodiment, the first image is brought into contact with a liquid absorbing member having a porous body to absorb liquid, and the amount of liquid in the first image is decreased. Let a first surface be a contact surface of the liquid absorbing member with the first image, and a porous body is disposed on the first surface. The liquid absorbing member having such a porous body preferably has a shape that allows movement along the movement of an ink receiving medium, and circulating liquid absorption in which after contact with the first image, the liquid absorbing member is brought into contact again with another first image in a predetermined period. For instance, a shape, such as an endless belt shape, or a drum shape, may be used.

(Porous Body)

As a porous body of a liquid absorbing member according to the embodiment, it is preferable to use a porous body having an average pore diameter on the first surface smaller than the average pore diameter on a second surface opposed to the first surface. The pore diameter is preferably small in order to reduce adhesion of an ink solid component to the porous body, and the average pore diameter of the porous body for the first surface at least on the side to be in contact with an image is preferably 10 μm or less, and additionally when the average pore diameter is 5 μm or less, ink filterability further increases. Furthermore, the average pore diameter may be 0.2 μm or less. Although the lower limit of the average pore diameter is not particularly limited, the lower limit may be, for instance, 0.2 μm or greater. It is to be noted that the average pore diameter in the embodiment indicates an average diameter on any of the first surface and the second surface, and the average diameter can be measured by a publicly known means, for instance, the mercury intrusion technique, the nitrogen adsorption method, or SEM image observation. When the diameter is made small, filterability can be increased. A size of diameter is set, which does not allow passing of an aggregating coloring material or an ink having an increased viscosity after ink used reacts to the reaction liquid so that coloring material adhesion to a layer deeper than a first layer of the porous body is reduced. Also, the thickness of the porous body is preferably reduced to achieve uniformly high air permeability. The air permeability can be indicated by a Gurley value defined in JIS P8117, and the Gurley value is preferably 10 seconds or less.

However, when the porous body is made thinner, a necessary capacity for absorbing the liquid component may not be sufficiently ensured, thus the porous body may have a multilayered structure.

Next, an embodiment when the porous body is in a multilayered configuration will be described. Here, a description is given by assuming that the first layer is on side in contact with the first image, and the second layer is the layer stacked on the surface opposite to the contact surface, with the first image, of the first layer. Furthermore, the multilayered configuration is expressed sequentially by the order of stacked layer from the first layer. In the present description, the first layer may be referred to as the "absorption layer", and the second and subsequent layer may be referred to as the "support layer".

[First Layer]

In the embodiment, the material for the first layer is not particularly limited, and it is possible to use both of a hydrophilic material having an angle of contact with water of less than 90° and a water-repellent material having an angle of contact with water of greater than 90°.

The hydrophilic material is preferably selected from a single material, such as cellulose and polyacrylamide, and composite materials of these. Also, the surface of the below-mentioned water-repellent materials may undergo hydrophilic treatment and be used. The hydrophilic treatment includes a sputter etching method, a method such as radioactive ray or $H_2O$ ion irradiation, excimer (ultraviolet ray) laser beam irradiation.

In the case of the hydrophilic material, the angle of contact with water is more preferably 60° or less. In the case of the hydrophilic material, the first layer provides an effect of sucking up an aqueous liquid component, particularly water by a capillary force.

Meanwhile, in order to reduce coloring material adhesion and improve the cleaning performance, the material for the first layer is preferably a water-repellent material having a low surface free energy, and particularly, fluororesin. Specifically, the fluororesin includes polytetrafluoroethylene (hereinafter PTFE), polychlorotrifluoroethylene (PCTFE), polyvinylidene fluoride (PVDF), polyvinyl fluoride (PVF), perfluoroalkoxy-fluororesin (PFA), tetrafluoroethylene-hexafluoropropylene copolymer (FEP), ethylene-tetrafluoroethylene copolymer (ETFE), and ethylene-chlorotrifluoroethylene copolymer (ECTFE). One type or two or more types of these resins may be used as necessary, and a configuration may be adopted in which multiple films are stacked in the first layer. In the case of the water-repellent material, almost no effect of sucking up an aqueous liquid component is provided by a capillary force, when the first layer comes into contact with an image for the first time, it may take time to suck up the liquid. For this reason, the first layer is preferably impregnated with liquid which has an angle of contact with the first layer of less than 90°. The liquid, with which the first layer is impregnated for the liquid in the first image, may be referred to as preparatory impregnation liquid. The reaction liquid may also be used as the preparatory impregnation liquid. The first layer can be impregnated with liquid by applying the liquid to the first surface of the liquid absorbing member. The preparatory impregnation liquid is preferably prepared by mixing first liquid (water) with a surface-active agent or liquid having a low angle of contact with the first layer.

In the embodiment, the film thickness of the first layer is preferably 50 μm or less, more preferably 35 μm or less, and even preferably 30 μm or less. For instance even when the pore diameter is 0.2 μm or less, the thickness of 35 μm or less allows an increase in flow resistance to be reduced, and smeared image to be prevented. In the Examples described below, the film thickness was measured at 10 arbitrary points by a rectilinear micrometer OMV 25 (manufacture by Mitutoyo), and the film thickness was obtained by calculating the average value of the measured thicknesses.

The first layer can be manufactured by a publicly known method of manufacturing a thin porous film. For instance, after a sheet-shaped resin material is obtained by a method such as an extrusion molding, the first layer can be obtained by drawing the sheet-shaped resin material to a predetermined thickness. Also, a porous film can be obtained by adding a plasticizer such as paraffin to the material for extrusion molding, and removing the plasticizer by heating or the like during drawing. The pore diameter can be regulated by adjusting the additive amount of plasticizer to be added and a draw ratio as needed.

[Second Layer]

The second layer is preferably a layer having air permeability. Such a layer may be non-woven fabric of resin fibers or woven fabric. Although the material for the second layer is not particularly limited, the first liquid preferably has an equivalent or lower angle of contact with the first layer so that the liquid absorbed in the first layer side does not flow backward. Specifically, the material for the second layer is preferably selected from single materials such as polyolefin (such as polyethylene (PE), polypropylene (PP)), polyurethane, polyamide such as nylon, polyester (such as polyethylene terephthalate (PET)), and polysulfone (PSF), or composite materials of these. Also, the second layer is preferably a layer having a pore diameter larger than the pore diameter of the first layer.

[Third Layer]

The porous body in a multilayered structure may have a configuration of three or more layers and is not limited to this. The third or subsequent layer (also called the third layer) is preferably a non-woven fabric from the viewpoint of rigidity. As the material, the same material as the second layer is used.

[Other Materials]

The liquid absorbing member may have a reinforcement member which reinforces the lateral side of the liquid absorbing member, other than the porous body in the above-mentioned stacked layer structure. Also, the liquid absorbing member may have a joining member when a belt-shaped member is formed by connecting the longitudinal ends of an elongated seat-shaped porous body. A non-porous tape material may be used as such material, and it is sufficient that the material be disposed at a position or with a period not in contact with an image.

[Method of Manufacturing Porous Body]

A method of forming a porous body by stacking the first layer and the second layer is not particularly limited. The layers may be simply stacked or the layers may be bonded to each other using a method such as lamination by adhesive agent or lamination by heating. In the present embodiment heat lamination is preferable from the viewpoint of air permeability. Also, for instance, part of the first layer or the second layer may be melted by heating and may be stacked adhesively. Also, a fusion material like hot melt powder may be interposed between the first layer and the second layer, and the layers may be stacked adhesively by heating. When the third and subsequent layers are stacked, the layers may be stacked at one time or may be stacked sequentially, and the order of stacking may be selected as appropriate.

In a heating step, the lamination method is preferable in which the porous body is nipped by a heated roller, and the porous body is heated while being pressurized.

<Cleaning Step (4) for Liquid Absorbing Member>

Cleaning step (4) is performed by bringing the cleaning member into contact with the first surface of the porous body, to be in contact with the first image, and separating an ink solid component on the first surface from the first surface. Here, a method having less effect on the first surface of the porous body can be selected, and it is preferable to bring the first surface into contact with particularly a cleaning member having a surface energy greater than the surface energy of the first surface of the porous body, and to separate an ink solid component by causing the ink solid component to be displaced to and absorbed by the surface of the cleaning member. When the liquid absorbing member rotationally moves like a belt shape or a roll shape, the cleaning member is preferably a roll shape or a belt shape in which a contact surface moves along with the liquid absorbing member.

<Liquid Collecting Step (5) for Liquid Absorbing Member>

In a liquid collecting step (5), liquid is collected so that the liquid absorbed by the porous body remains on the side of the first surface of the porous body. Although for the liquid collection, any of publicly known means may be used, such as liquid extrusion by a pressurized gas using an air knife or the like, press by an absorbing member such as a sponge, suction by a negative pressure application, or squeezing, a means causing less deterioration of the liquid absorbing member is preferable. As long as the liquid absorbed by the porous body remains on the side of the first surface of the porous body, the liquid collection may be made from any of the first surface and the second surface. Among all, a method of collecting liquid by blowing a pressurized gas by an air knife or the like onto the second surface of the porous body and pressing out liquid from the second surface by a pressure is preferable because the liquid is likely to remain on the side of the first surface. In this process, liquid is collected by adjusting the ejection pressure of the pressurized gas so that the absorbed liquid remains on the side of the first surface of the porous body. Also, it is preferable to use a porous body having an average surface pore diameter on the first surface smaller than the average surface pore diameter on the second surface, particularly a porous body in a stacked layer structure.

It is to be noted that the liquid collecting step (5) and the cleaning step (4) may be performed at the same time. For instance, collection of a liquid component and cleaning can be performed through and on the first surface of the liquid absorbing member by using a porous member as the cleaning member. Also in this case, when liquid collection is made so that the liquid absorbed by the porous body partially remains, the liquid remains on the side of the first surface of the porous body.

<Description of Mechanism>

In the embodiment, on an ink receiving medium and in the porous body in an event where the porous body of the liquid absorbing member comes into contact with the first image, more first chemical species contributing to reaction of the ink viscosity-increasing component are contained in terms of a molar equivalent per unit area than second chemical species in an ink, which react with the ink viscosity-increasing component. In order to achieve the above-mentioned state, (i) the liquid absorbed by bringing the liquid absorbing member into contact with the first image contains the ink viscosity-increasing component, and (ii) in the liquid collecting step for collecting the liquid absorbed by the porous body, liquid is collected so that the liquid containing the ink viscosity-increasing component remains on the side of the first surface of the porous body.

The inventor infers that the effect due to the above-described two configurations is achieved by the following mechanism. First, FIGS. 7A to 7D illustrate images in the case where the liquid absorbed from an ink receiving medium excessively contains the ink viscosity-increasing component, and FIGS. 8A to 8C illustrate images in the case where the liquid does not contain excessive ink viscosity-increasing component.

Figure 7A:
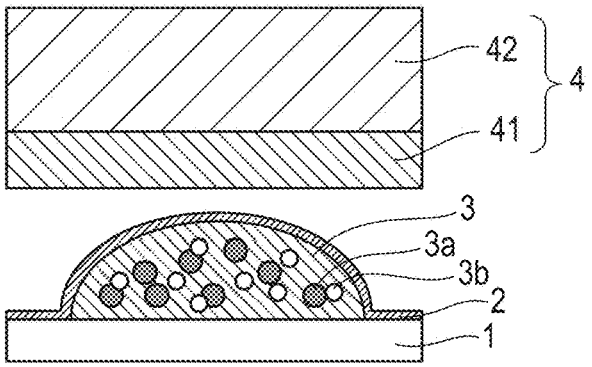
FIG. 7A is an image drawing illustrating a liquid absorbing mechanism of the present invention.
Figure 7B:
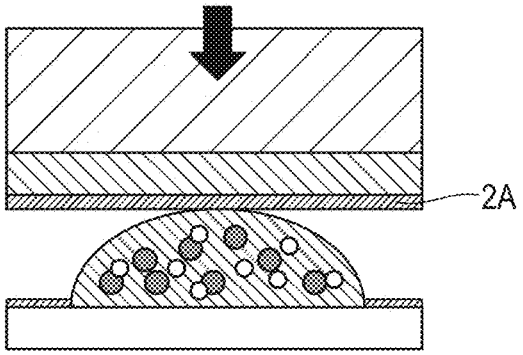
FIG. 7B is an image drawing illustrating the liquid absorbing mechanism of the present invention.
Figure 8A:
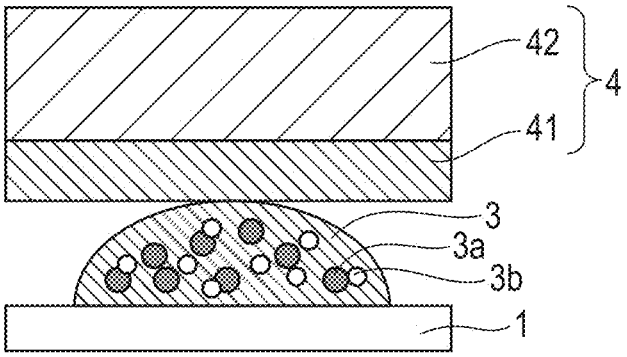
FIG. 8A is an image drawing illustrating a liquid absorbing mechanism in other than the present invention.
Figure 8B:
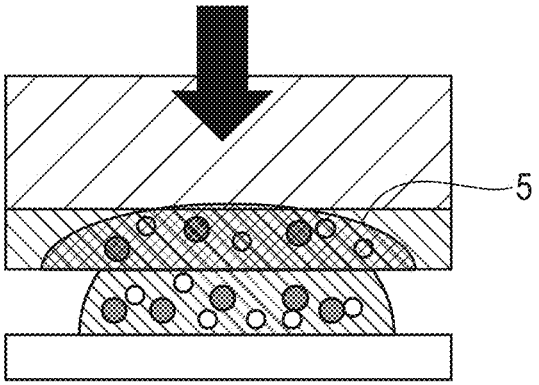
FIG. 8B is an image drawing illustrating the liquid absorbing mechanism in other than the present invention.
Figure 8C:
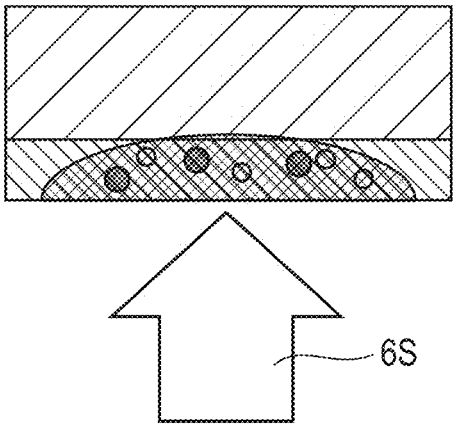
FIG. 8C is an image drawing illustrating the liquid absorbing mechanism in other than the present invention.

The states before liquid component is absorbed are illustrated in FIG. 7A and FIG. 8A, respectively. When liquid absorption is made in the state of FIG. 8A, in which excessive ink viscosity-increasing component is not contained on the ink receiving medium, as illustrated in FIG. 8B, an ink solid component (such as coloring materials 3*a* and resin particles 3*b*) contained in a first image 3 may intrude along with liquid 5 absorbed inside a porous body 4. In this case, the ink solid component, which has intruded, clog the pores of the porous body 4, and liquid absorption performance deteriorates. In order to reduce deterioration of the liquid absorption performance, the ink solid component inside the liquid absorbing member needs to be removed by cleaning the liquid absorbing member. However, powerful cleaning 6S is necessary to remove the ink solid component inside the liquid absorbing member, and thus the durability of the liquid absorbing member is degraded (FIG. 8C). Clogging of the pores of the porous body gradually advances by an ink solid component which intrudes each time liquid absorption is repeated, and deterioration of liquid absorption performance becomes noticeable as the number of cycles increases.

Figure 7C:
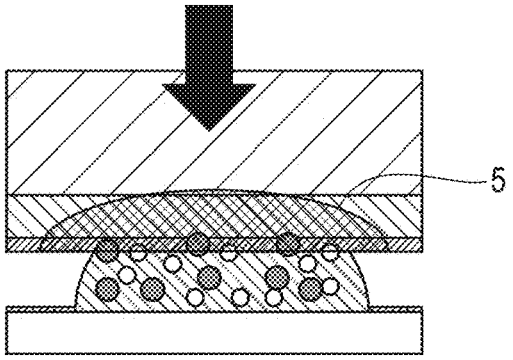
FIG. 7C is an image drawing illustrating the liquid absorbing mechanism of the present invention.

In contrast, since an ink viscosity-increasing component 2 is excessively contained in an ink receiving medium 1 in FIG. 7A, due to contact between the porous body 4 and the first image 3, a film 2A of the ink viscosity-increasing component is formed (FIG. 7B) on the contact surface of the porous body 4, and the ink solid component contained in the first image 3 further reacts with the ink viscosity-increasing component on the surface of the porous body 4 to increase the viscosity, and as illustrated in FIG. 7C, it is inferred that the ink solid component partially remains on the surface of the porous body 4 without intruding into the inside of the porous body 4. At this point, when excessive presence of the ink viscosity-increasing component in a molar equivalent is satisfied with a parent population of the chemical species remaining in the side of the porous body 4 on the surface of the porous body 4 and the chemical species which move from the side of the ink receiving medium 1 to the side of the porous body 4, it is considered that the effect of remaining the above-described ink solid component on the surface of the porous body 4 is produced. It is assumed that excessive ink viscosity-increasing component does not need to be present on the surface of the porous body 4 for the chemical species which continue to remain on the side of the ink receiving medium 1 without moving to the porous body 4 side.

Figure 7D:
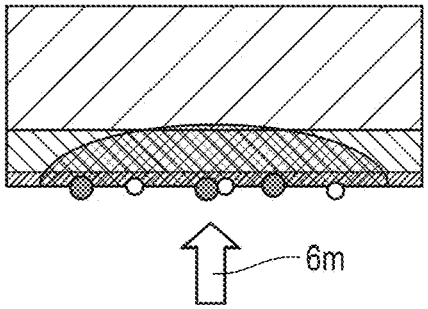
FIG. 7D is an image drawing illustrating the liquid absorbing mechanism of the present invention.

Consequently, only the ink solid component having an increased viscosity remaining on the surface of the porous body 4 just has to be removed by cleaning, and cleaning 6*m* causing less damage to the porous body of the liquid absorbing member, such as absorption exfoliation, may be selected (FIG. 7D). However, an image region to which an ink is applied and in which an image is formed, and a non-image region to which an ink is not applied and only the reaction liquid is applied are formed on the ink receiving medium. For this reason, an excessive amount of the ink viscosity-increasing component is different between the image region and the non-image region, and a sufficient ink viscosity-increasing component may not be absorbed by the porous body in the image region. For this reason, in a liquid absorbing step for the first time, an ink solid component may permeate the inside of the porous body. Although the excessive amount in the image region can be sufficiently ensured by application of a large amount of reaction liquid, the amount of liquid to be absorbed is increased accordingly, and sufficient liquid absorption cannot be made and target suppression of curl or cockling cannot be achieved. Also, due to an excessive amount of reaction liquid applied, "smeared image", in which an image is pushed to flow at the time of liquid absorption, may occur, and the image quality may be reduced. When the concentration of the ink viscosity-increasing component in the reaction liquid is increased more than necessary, the viscosity of the reaction liquid is increased, and uniform application of the reaction liquid is difficult. Since the amount of application of reaction liquid is limited like this, the ink solid component in the image region cannot be kept on the surface of the porous body in some cases.

Figure 9:
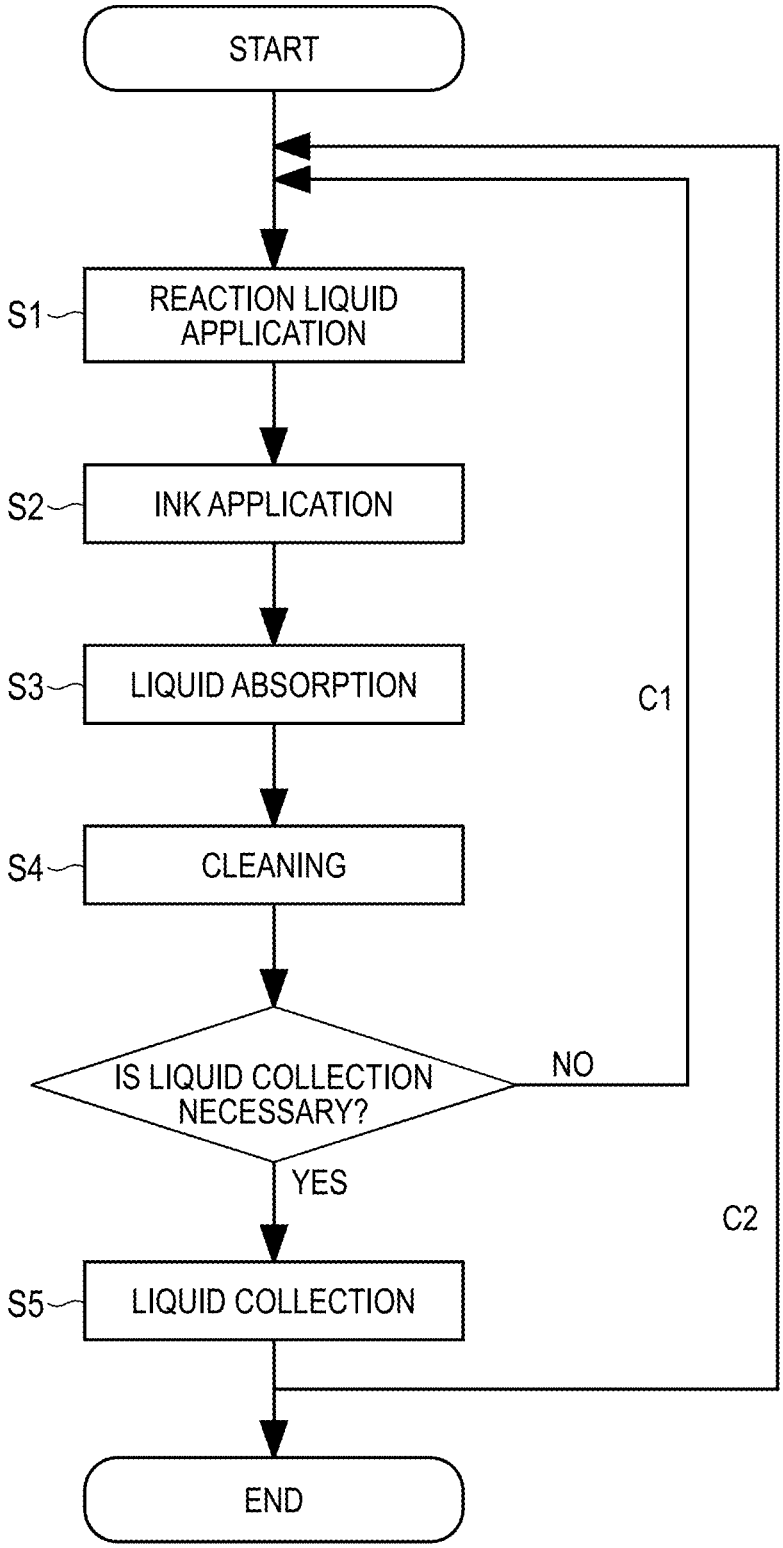
FIG. 9 is a flow diagram of a sequence of an ink jet printing method of the present invention.
Figure 10:
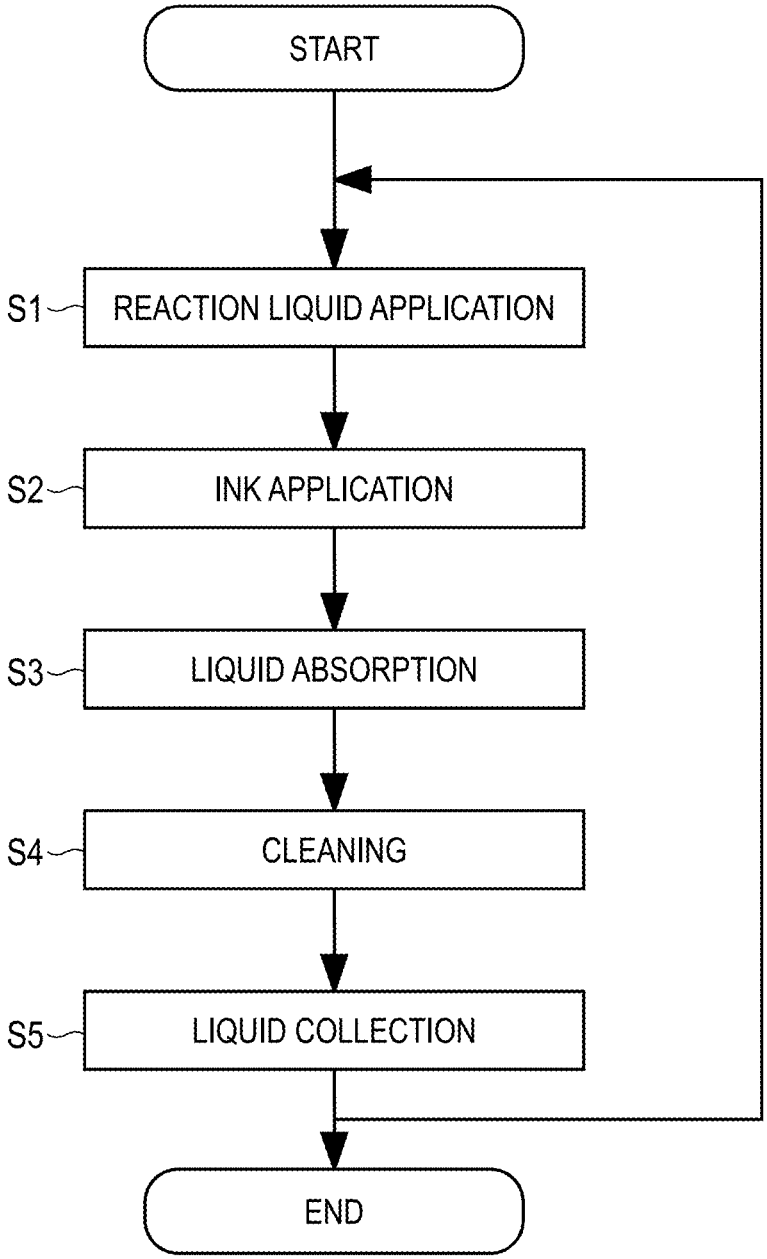
FIG. 10 is a flow diagram of a sequence of an ink jet printing method in Example 1.

FIG. 9 is a flow illustrating the main sequence of an ink jet printing method according to the embodiment. As described above, when printing is started, the steps of reaction liquid application (S1), ink application (S2), liquid absorption (S3), and cleaning (S4) are performed, and at this stage, necessity of liquid collection from the liquid absorbing member is determined. When the liquid collection is determined to be necessary, the step of liquid collection (S5) is performed, and the flow returns to S1 (cycle C2). Normally, the liquid absorbing member has an amount of liquid greater than the amount of liquid to be absorbed in one cycle of steps S1 to S4, and the step of subsequent liquid collection (S5) does not have to be necessarily performed for each cycle. Therefore, the cycle C1, in which S1 to S4 steps are repeated, can be performed until a predetermined amount of liquid is reached. It is to be noted that when printing is completed, the flow does not return to the cycle of C2 after S5 and the printing is completed. Also, as illustrated in FIG. 10, steps of S1 to S5 similarly to the sequence of FIG. 9 may be performed as 1 cycle without determining the necessity of liquid collection. Repeating cycles C1, C2 in this manner causes the porous body to contain liquid containing the absorbed ink viscosity-increasing component, and due to transfer of the ink viscosity-increasing component, decrease in the concentration difference occurs. In S5 step, liquid is collected so that the liquid remains on the side of the first surface of the porous body. When all of the liquid containing the ink viscosity-increasing component in the porous body is collected for each liquid collection, decrease in the concentration difference is reset for each cycle C2, and as mentioned above, an adhering material cannot be kept on the surface of the porous body in the image region, and the probability that an ink solid component permeates the inside of the porous body is increased, thus the liquid absorption performance and the durability are not satisfied. The main point of the mechanism in the embodiment is that clogging of the porous body is prevented for a long period of time by reducing the probability of permeation of the ink solid component into the porous body and the cleaning is facilitated. In the reaction liquid application (S1), it is preferable that the molar equivalent of the first chemical species in the reaction liquid applied, such as proton ions ($H^+$) or hydronium ions ($H_3O^+$) which contribute to increase in the ink viscosity, be two or more times greater than the molar equivalent of the second chemical species such as carboxylate ions (—$COO^-$) in the ink when a maximum amount of the ink is applied. Consequently, a sufficiently large amount of the ink viscosity-increasing component in the reaction liquid is applied, the sufficiently large amount being an amount more than necessary to increase the viscosity of a maximum amount of the ink applied. From the first time, the probability of permeation of the ink solid component into the porous body is reduced. For the second time or later, the molar equivalent of the first chemical species contained in the ink receiving medium and the porous body is further increased, and the effect of keeping the ink solid component on the surface of the porous body is enhanced, thus the cleaning performance is further improved. The upper limit of the ratio (the molar equivalent of the first chemical species/the molar equivalents of the second chemical species) of molar equivalents of the first chemical species and second chemical species is not particularly restricted, and may be in a range allowing preparation of reaction liquid having a concentration applicable with substantially uniformly within the amount of application of the reaction liquid satisfying the amount of liquid absorbable by the liquid absorbing member after ink application.

In this manner, both performance retention and high durability of the porous body having the liquid absorbing member can be achieved only when the following two conditions are satisfied: (i) in the step of bringing the liquid absorbing member into contact with an image, the ink viscosity-increasing component is contained in the liquid absorbed by the porous body, and (ii) in the liquid collecting step, liquid is collected so that the liquid remains on the side of the first surface of the porous body.

Figure 11:
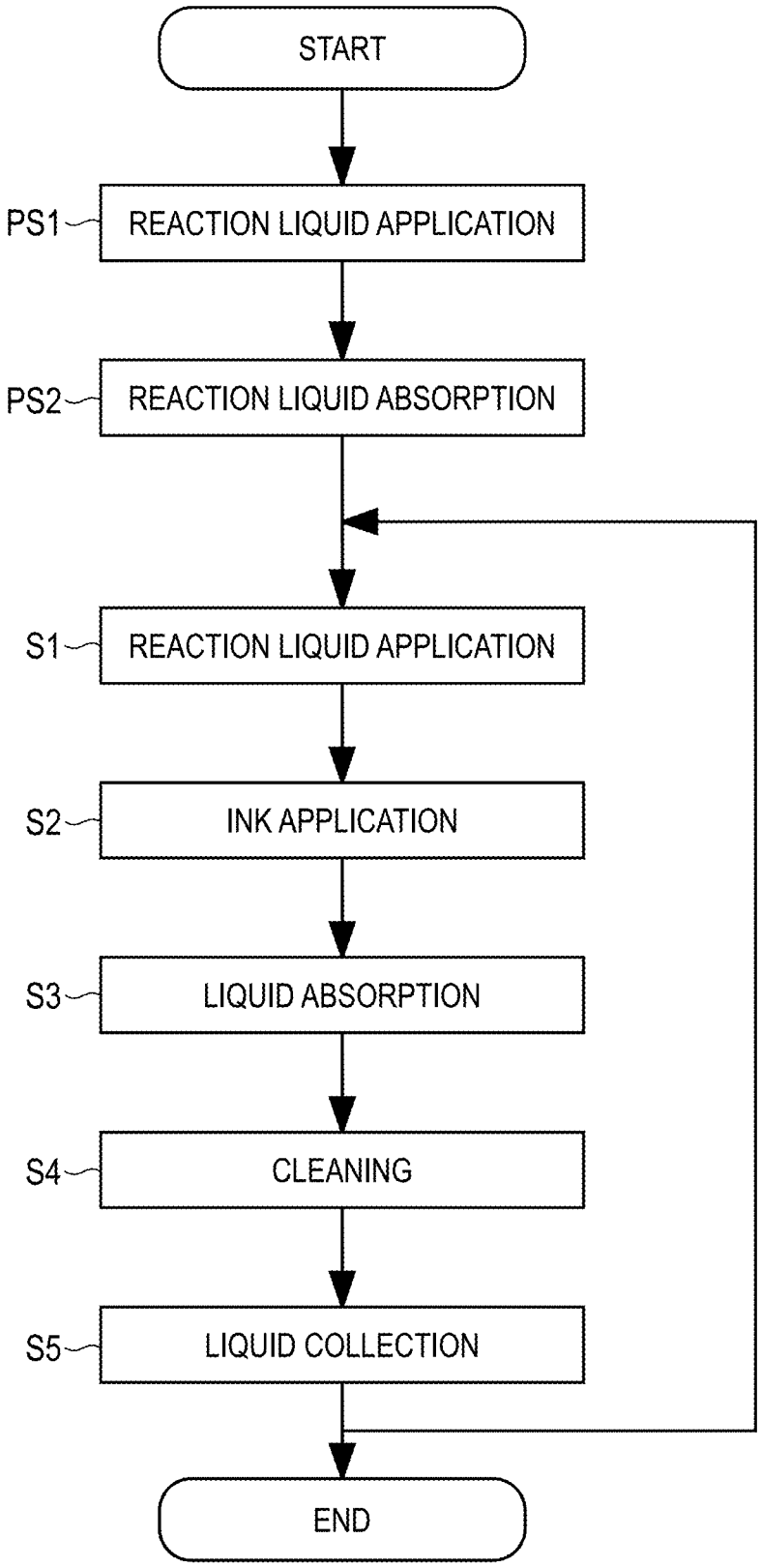
FIG. 11 is a flow diagram of a sequence of an ink jet printing method in Example 3.

Also, in order for the ink viscosity-increasing component to be sufficiently present in the porous body of the liquid absorbing member from the initial stage, reaction liquid filling sequence PS1, PS2 for the liquid absorbing member as illustrated in FIG. 11 is performed before the start of the above-mentioned cycle, for instance, at the start-up of the apparatus, thereby making it possible to fill the inside of the porous body with the ink viscosity-increasing component, and enhance the effect by the embodiment from the initial stage. This sequence after the reaction liquid absorption in PS2 includes the same flow as in the cycle illustrated in FIG. 10.

In this sequence, first, in PS1, reaction liquid containing the ink viscosity-increasing component is applied onto an ink receiving medium such as a transfer body. Although an ink is applied onto an ink receiving medium by the ink application (S2) in a normal printing sequence, next, in PS2, in the present sequence, ink application is not performed, and only the reaction liquid is absorbed in the liquid absorbing member. Thus, at the start-up of the apparatus, it is possible to fill the liquid absorbing member with the ink viscosity-increasing component substantially uniformly. As a result, from the first printing trial at the start-up of the apparatus, a favorable film 2A of the ink viscosity-increasing component is formed, and thus the effect of keeping the ink solid component on the surface of the porous body can be exhibited.

Also, the above-mentioned filling sequence in the embodiment is not only applied at the start-up of the apparatus, but also is desirably performed immediately before a printing operation in a situation where the printing operation is performed with the liquid absorbing member not filled with the reaction liquid. For instance, the filling sequence may be performed before the cycle at the timing such as after the liquid absorbing member is replaced, or when printing has not been performed for a long time since the last printing.

It is to be noted that in PS1 step and PS2 step, reaction liquid filling may be performed through the first surface of the porous body of the liquid absorbing member, and the reaction liquid may be directly applied to the liquid absorbing member. Subsequently, the same sequence as in FIG. 9 or FIG. 10 proceeds.

Next, a specific example of an embodiment of the ink jet printing apparatus capable of performing the ink jet printing method of the above-described embodiment will be described.

The ink jet printing apparatus of the present embodiment includes: an ink jet printing apparatus that forms a first image on a transfer body as an ink receiving medium, and transfers a second image to a printing medium, the second image with part of the liquid absorbed by a liquid absorbing member; and an ink jet printing apparatus that forms a first image on a printing medium as an ink receiving medium. The former ink jet printing apparatus is hereinafter referred to as the transfer type ink jet printing apparatus for the sake of convenience, and the latter ink jet printing apparatus is hereinafter referred to as the direct drawing type ink jet printing apparatus for the sake of convenience.

Hereinafter each ink jet printing apparatus will be described.

(Transfer Type Ink Jet Printing Apparatus)

In a transfer type ink jet printing apparatus, an ink receiving medium is a transfer body that temporarily holds a first image and a second image in which first liquid is absorbed from the first image. Also, the transfer type ink jet printing apparatus includes a transfer unit including a transferring member that transfers the second image onto a printing medium on which an image is to be formed.

FIG. 1 is a schematic view illustrating an example of a schematic configuration of a transfer type ink jet printing apparatus in the present embodiment.

As illustrated in FIG. 1, a transfer type ink jet printing apparatus 100 in the embodiment includes: a transfer body 101 supported by a support member 102; a reaction liquid applying device 103 that applies reaction liquid onto the transfer body 101; an ink applying device 104 that applies an ink onto the transfer body 101 with the reaction liquid applied thereto, and forms the first image on the transfer body; a liquid absorbing device 105 that absorbs a liquid component from the first image on the transfer body; and a transferring member 106 that transfers the second image with the liquid component removed on the transfer body onto a printing medium 108 such as paper. Also, the transfer type ink jet printing apparatus 100 may have a cleaning member for transfer body 109 that cleans the surface of the transfer body 101 after transfer as needed.

The support member 102 rotates around the center at a rotational shaft 102*a* in the direction of the arrow A of FIG. 1. The rotation of the support member 102 causes the transfer body 101 to be moved. The reaction liquid by the reaction liquid applying device 103, and the ink by the ink applying device 104 are sequentially applied onto the transfer body 101 moved, and the first image is formed on the transfer body 101. The first image formed on the transfer body 101 is moved to a position in contact with a liquid absorbing member 105*a* included in the liquid absorbing device 105 by the movement of the transfer body 101.

The liquid absorbing member 105*a* of the liquid absorbing device 105 is moved in synchronization with the rotation of the transfer body 101. The first image formed on the transfer body 101 passes through a state in contact with the liquid absorbing member 105*a* which is moved. During the period, the liquid absorbing member 105*a* removes the liquid component from the image.

It is to be noted that the image undergoes a state where the image is in contact with the liquid absorbing member 105*a*, and a liquid component is thereby removed. In this process, from the viewpoint of effectively functioning the liquid absorbing member 105*a*, the present device configuration is a particularly preferable when the image and the liquid absorbing member 105*a* are brought into a state of contact by a predetermined pressing force.

The removal of the liquid component can be expressed from a different point of view as concentrating the ink constituting the first image formed on the transfer body. Concentrating the ink means that the proportion of the solid component contained in the ink, such as coloring material and resin, with respect to the liquid component contained in the ink increases owing to reduction in the liquid component.

The second image with the liquid component removed is moved to a transferring unit to be in contact with the printing medium, by the movement of the transfer body 101, and the second image is brought into contact with the printing medium 108 conveyed to the transferring unit by a printing medium conveying device 107, and thus an image is formed on the printing medium 108. The post-transfer ink image transferred onto the printing medium 108 is a reverse image of the second image. In the subsequent description, the post-transfer ink image may be referred to as a third image distinguished from the above-described first image (ink image before liquid removal), and the second image (ink image after liquid removal).

Since an image is formed on the transfer body after the reaction liquid is applied, then the ink is applied on the transfer body, the reaction liquid remains on a non-image region without reacting with the ink. In the present device, the liquid absorbing member 105*a* comes into contact with not only an image but also the unreacted reaction liquid, and the liquid component of the reaction liquid is also removed.

Therefore, although the expression "the liquid component is removed from an image" is used for description in the above, the expression is not used in a limited sense that the liquid component is removed only from an image, but is used in a sense that the liquid component may be removed at least from the image on the transfer body. For instance, it is also possible to remove the liquid component in the reaction liquid applied to a region outwardly of the first image as well as in the first image. The liquid component has no certain form, has fluidity, and substantially constant volume, and is not particularly limited.

For instance, water and an organic solvent contained in the ink and the reaction liquid may be the liquid component.

Also even when the above-described clear ink is contained in the first image, the ink can be concentrated by liquid absorbing treatment. For instance, when clear ink is applied onto a color ink containing the coloring material applied onto the transfer body 101, the clear ink is extensively present on the surface of the first image, or the clear ink is partially present at one portion or multiple portions on the surface of the first image, and color ink is present on other portions. When the clear ink is overall present on the surface of the first image, the porous body absorbs the liquid component of the clear ink on the surface of the first image, and the liquid component of the clear ink is moved. Accordingly, the liquid component in the color ink is moved to the porous body, and thus the aqueous liquid component in the color ink is absorbed. On the other hand, at a portion where the region of the clear ink and the region of the color ink are present on the surface of the first image, the liquid component of each of the color ink and the clear ink is moved to the porous body, and thus the aqueous liquid component is absorbed. The clear ink may contain a great amount of the component for improving the transferability of an image from the transfer body 101 to the printing medium. For instance, the content of a component may be increased, the component providing more adhesion to the printing medium by heating than the color ink.

The configuration of the transfer type ink jet printing apparatus of the present embodiment will be described below with referring to FIG. 1.

<Transfer Body>

The transfer body 101 has a surface layer including an image forming surface. Although various materials such as resins, ceramics may be used as appropriate as the member of the surface layer, a material having a high compressive elastic modulus is preferable in respect of durability. Specifically, an acrylic resin, acrylics silicone resin, fluoride containing resin, and condensation product obtained by condensing hydrolyzable organic silicon compound. In order to improve the wettability, and the transferability of the reaction liquid, surface treatment may be made and used. The surface treatment includes frame treatment, corona treatment, plasma treatment, polish treatment, roughening treatment, active energy ray irradiation treatment, ozonization, surfactant treatment, and silane coupling treatment. Some of these may be combined. Also, any surface shape may be provided in the surface layer.

Also, the transfer body preferably includes a compressible layer having a function of absorbing a pressure fluctuation. Provided with a compressible layer the transfer body allows deformation to be absorbed by the compressible layer, and is enabled to distribute local pressure fluctuation when the fluctuation occurs, and therefore maintain favorable transferability even in high-speed printing. The member for the compressible layer includes, for instance, acrylonitrile butadiene rubber, acrylic rubber, chloroprene rubber, urethane rubber, and silicone rubber. At the time of molding the above-mentioned rubber material, it is preferable that predetermined amounts of vulcanizing agent, vulcanizing accelerator be blended, and bulking agents such as foaming agents, hollow particles or salts be further blended as necessary to provide a porous property. Consequently, for various pressure fluctuations, air bubble portions are compressed according to a volume change, and thus deformation is small in a direction other than a compression direction, and more stable transferability, and durability can be obtained. Porous rubber materials may have a continuous pore structure in which the pores are continuous, and an independent pore structure in which the pores are independent from each other. In the present embodiment, either structure may be used, and these structures may be used in combination.

Furthermore, the transfer body preferably has an elastic layer between the surface layer and the compressible layer. Various materials such as resins, ceramics may be used as appropriate as the member of the elastic layer. Various elastomer materials, and rubber materials are preferably used in respect of machining characteristics. Specifically, for instance, fluoro silicone rubber, phenyl silicone rubber, fluorocarbon rubber, chloroprene rubber, urethane rubber, nitrile rubber, ethylene propylene rubber, crude rubber, styrene rubber, polyisoprene rubber, butadiene rubber, copolymer of ethylene/propylene/butadiene, and nitrile butadiene rubber may be used. Particularly, silicone rubber, fluoro silicone rubber, and phenyl silicone rubber are preferable in respect of dimensional stability, and durability because compression permanent distortion is small. In addition, these are also preferable in respect of transferability because the change in the elastic modulus due to a temperature is small.

Various adhesive agents and double-sided tapes may be used between the layers (the surface layer, the elastic layer, the compressible layer) constituting the transfer body in order to fix and hold these layers. In addition, to reduce lateral extension and maintain sturdiness when a device is mounted, a reinforcement layer having a high compressive elastic modulus may be provided. Also, woven fabric may serve as a reinforcement layer. The transfer body can be produced by combining the layers based on the above-mentioned materials in any manner.

The size of the transfer body can be freely selected according to a target print image size. The shape of the transfer body is not particularly restricted, and specifically, a seat shape, a roller shape, a belt shape, and an endless web shape may be used.

<Support Member>

The transfer body 101 is supported on the support member 102. Various adhesive agents and double-sided tapes may be used as the support method for the transfer body. Alternatively, a member for installation composed of a material such as metal, ceramic, resin may be mounted on the transfer body, and the transfer body may be supported on the support member 102 using the member for installation.

From the viewpoint of conveyance accuracy and durability, the support member 102 requires a certain level of structural strength. Metal, ceramic, resin and the like are preferably used for the material of the support member. Among all, particularly, in addition to provide the rigidity capable of sustaining the pressure in transfer, and dimensional accuracy, in order to improve the responsiveness of control by reducing the inertia during operation, aluminum, iron, stainless steel, an acetal resin, an epoxy resin, polyimide, polyethylene, polyethylene terephthalate, nylon, polyurethane, silica ceramics, and alumina ceramics are preferably used. In addition, using these in a combination is also preferable.

<Reaction Liquid Applying Device>

The ink jet printing apparatus of the embodiment has the reaction liquid applying device 103 that applies reaction liquid to the transfer body 101. The reaction liquid applying device 103 of FIG. 1 indicates the case of a gravure offset roller that has a reaction liquid container 103*a* that contains the reaction liquid, and reaction liquid applying members 103*b*, 103*c* that apply the reaction liquid in the reaction liquid container 103*a* onto the transfer body 101.

<Ink Applying Device>

The ink jet printing apparatus of the embodiment has the ink applying device 104 that applies an ink to the transfer body 101 to which the reaction liquid has been applied. The first image is formed by mixing the reaction liquid and the ink, and the liquid component is absorbed from the first image by the subsequent liquid absorbing device 105.

<Liquid Absorbing Device>

In the present embodiment, the liquid absorbing device 105 has the liquid absorbing member 105*a*, and a pressing member 105*b* that presses the liquid absorbing member 105*a* against the first image on the transfer body 101. The shape of the liquid absorbing member 105*a* and the pressing member 105*b* is not particularly restricted. For instance, as illustrated in FIG. 1, a configuration may be adopted in which the pressing member 105*b* has a cylindrical shape, the liquid absorbing member 105*a* has a belt shape, and the cylindrical-shaped pressing member 105*b* presses the belt-shaped liquid absorbing member 105*a* against the transfer body 101. Alternatively, a configuration may be adopted in which the pressing member 105*b* has a cylindrical shape, the liquid absorbing member 105*a* has a tubular shape formed on the circumferential surface of the cylindrical-shaped pressing member 105*b*, and the cylindrical-shaped pressing member 105*b* presses the tubular-shaped liquid absorbing member 105*a* against the transfer body.

In the present embodiment, the liquid absorbing member 105*a* preferably has a belt shape in consideration of the space in the ink jet printing apparatus.

Alternatively, the liquid absorbing device 105 having such belt-shaped liquid absorbing member 105*a* may have an extending member that extends over the liquid absorbing member 105*a*. In FIGS. 1, 105*c*, 105*d*, and 105*e* indicate extending rollers as the extending member. In FIG. 1, the pressing member 105*b* also serves as a roller member that rotates similarly to the stretching roller. However, the invention is not limited to this. In the liquid absorbing device 105, the liquid absorbing member 105*a* having the porous body is brought into contact with the first image by the pressing member 105*b*, and thus the liquid component contained in the first image is absorbed by the liquid absorbing member 105*a*, and the second image is formed in which the liquid component is removed from the first image. In addition to the present method of contacting the liquid absorbing member, as the method of reducing the liquid component in the first image, conventionally used various techniques, for instance, a heating method, a low humidity air ventilation method, and a decompression method may be combined. Also, these methods may be applied to the second image with reduced liquid component to further reduce the liquid component.

Hereinafter, the various conditions and the configuration in the liquid absorbing device 105 will be described in detail.

(Pretreatment)

In the present embodiment, before the liquid absorbing member 105*a* having the porous body is brought into contact with the first image, pretreatment is preferably performed by a pretreatment unit (not illustrated in FIGS. 1 and 2) that applies treatment liquid to the liquid absorbing member. The treatment liquid used in the embodiment preferably contains water and a water-soluble organic solvent. The water is preferably deionized water produced by ion exchange. Also, the type of water-soluble organic solvent is not particularly limited, and any publicly known organic solvent, such as ethanol and isopropyl alcohol, may be used. Although the application method is not particularly limited in the pretreatment for the liquid absorbing member used in the present embodiment, the application method is preferably immersion or liquid drop. PS1, PS2 illustrated in FIG. 11 may be performed as the pretreatment, and the reaction liquid may serve as pretreatment liquid.

(Pressurizing Condition)

When the pressure of liquid absorbing member brought into contact with to a first image on the transfer body is higher than or equal to 2.9 N/cm$^2$ (0.3 kgf/cm$^2$), solid-liquid separation can be achieved for the liquid in the first image in a shorter time, and thus the liquid component can be removed from the first image, which is preferable. It is to be noted that the pressure of a liquid absorbing member in the present description indicates the nip pressure between an ink receiving medium and the liquid absorbing member, and surface pressure measurement was performed by the surface pressure distribution measuring device (I-SCAN, manufactured by Nitta Corporation), and the value of nip pressure was calculated by dividing the weight in a pressurized region by the area.

(Application Time)

The application time during which the liquid absorbing member 105*a* is in contact with the first image is preferably less than or equal to 50 ms in order to avoid adhesion of the coloring material in the first image to the liquid absorbing member. Here, the application time in the present description is calculated based on the above-mentioned surface pressure measurement by dividing a pressure detection width in a movement direction of an ink receiving medium by the movement speed of the ink receiving medium. Hereinafter, the application time is referred to as the liquid absorbing nip time.

In this manner, the liquid component is absorbed from the first image, and the second image with a reduced liquid component is formed on the transfer body 101. The second image is then transferred onto the printing medium 108 in the transfer unit. The device configuration and conditions for the transfer will be described.

<Transferring Member>

The present embodiment has a unit to transfer the second image on the transfer body 101 onto the printing medium 108 conveyed by the printing medium conveying unit 107 by bringing the second image into contact with the printing medium 108 by the transferring member 106. After the liquid component contained in the first image on the transfer body 101 is removed, the image is transferred to the printing medium 108, thus it is possible to obtain a recorded image with curl and cockling suppressed.

From the viewpoint of conveyance accuracy of the printing medium 108 and durability, the transferring member 106 requires a certain level of structural strength. Metal, ceramic, resin and the like are preferably used for the material of the transferring member 106. Among all, particularly, in addition to provide the rigidity capable of sustaining the pressure in transfer, and dimensional accuracy, in order to improve the responsiveness of control by reducing the inertia during operation, aluminum, iron, stainless steel, an acetal resin, an epoxy resin, polyimide, polyethylene, polyethylene terephthalate, nylon, polyurethane, silica ceramics, and alumina ceramics are preferably used. In addition, these may be used in a combination.

Although the contacting time during which the second image on the transfer 101 is brought into contact with the printing medium 108 is not particularly restricted, the time is preferably 5 ms or greater and 100 ms or less in order to favorably transfer the second image and not to impair the durability of the transfer body. It is to be noted that the contacting time in the present embodiment indicates the time during which the printing medium 108 and the transfer body 101 are in contact with each other, and surface pressure measurement was performed by the surface pressure distribution measuring device (I-SCAN, manufactured by Nitta Corporation), and the value of the pressing time was calculated by dividing a conveyance direction length by a conveyance speed.

Also, although the pressure with which the second image on the transfer 101 is bought into contact with the printing medium 108 is not particularly restricted, the pressure is preferably 9.8 N/cm$^2$ (1 kg/cm') or greater and 294.2 N/cm$^2$ (30 kg/cm') or less in order to favorably transfer the second image and not to impair the durability of the transfer body. It is to be noted that the pressure in the present embodiment indicates the nip pressure between the printing medium 108 and the transfer body 101, and surface pressure measurement was performed by the surface pressure distribution measuring device, and the value of nip pressure was calculated by dividing the weight in a pressurized region by the area.

Although the temperature at which the second image on the transfer 101 is brought into contact with the printing medium 108 is not particularly restricted, the temperature is preferably higher than or equal to the glass transition point or the softening point of the resin component contained in the ink. Also, for heating, a heating device, which heats the second image on the transfer body 101, the transfer body 101 and the printing medium 108, is preferably provided.

Although the shape of the transferring member 106 is not particularly restricted, for instance, a roller-shaped transferring member 106 may be used.

<Printing Medium and Printing Medium Conveying Device>

In the present embodiment, the printing medium 108 is not particularly limited, and any publicly known printing medium may be used. The printing medium includes a long object which is wound in a roll shape or sheets cut in a predetermined length. The material includes paper, plastic film, wood board, corrugated paper, and a metal film.

Also, in FIG. 1, the printing medium conveying device 107 for conveying the printing medium 108 includes a printing medium feeding roller 107*a* and a printing medium winding roller 107*b*. However, it is sufficient if the printing medium can be conveyed, and the configuration is not particularly limited to this.

<Control System>

Figure 3:
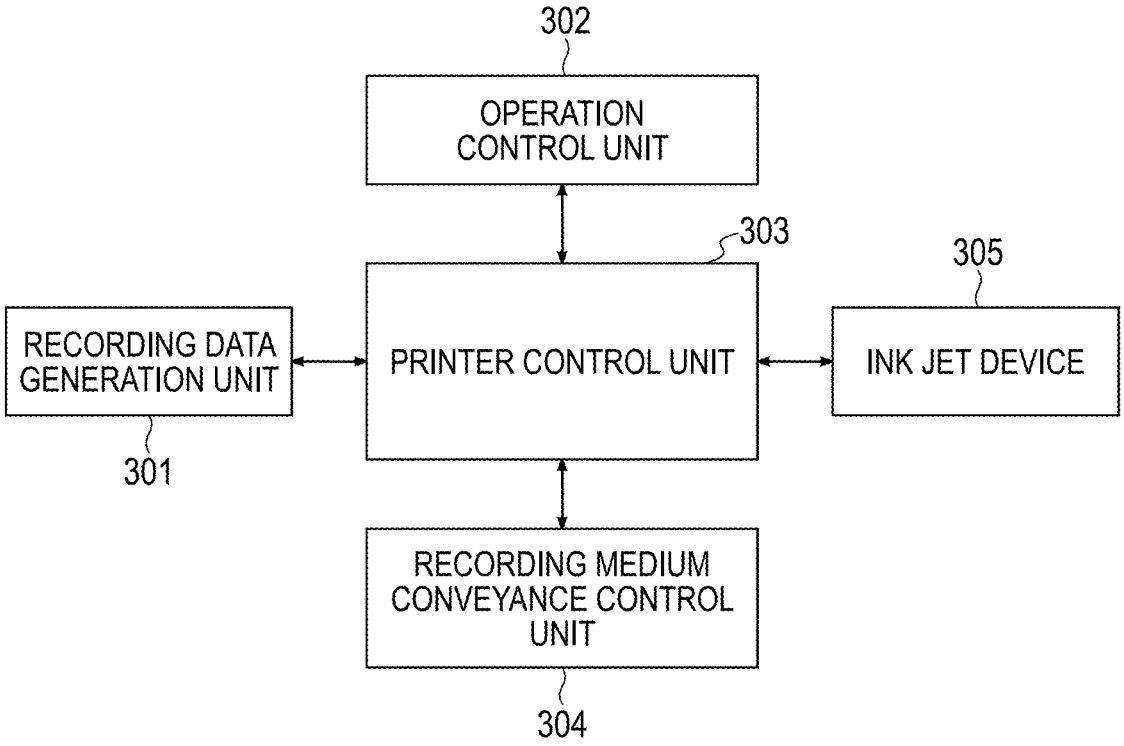
FIG. 3 is a block diagram illustrating a control system for an entire apparatus in the ink jet printing apparatuses illustrated in FIGS. 1 and 2.

The transfer type ink jet printing apparatus in the present embodiment has a control system that controls devices. FIG. 3 is a block diagram illustrating the control system for the entire apparatus in the transfer type ink jet printing apparatuses 1 to 3 illustrated in FIG. 1.

In FIG. 3, 301 indicates a printing data generation unit such as an external print server, 302 indicates an operation control unit such as an operation panel, 303 indicates a printer control unit for carrying out a printing process, 304 indicates a printing medium conveyance control unit for conveying a printing medium, and 305 indicates an ink jet device for printing.

Figure 4:
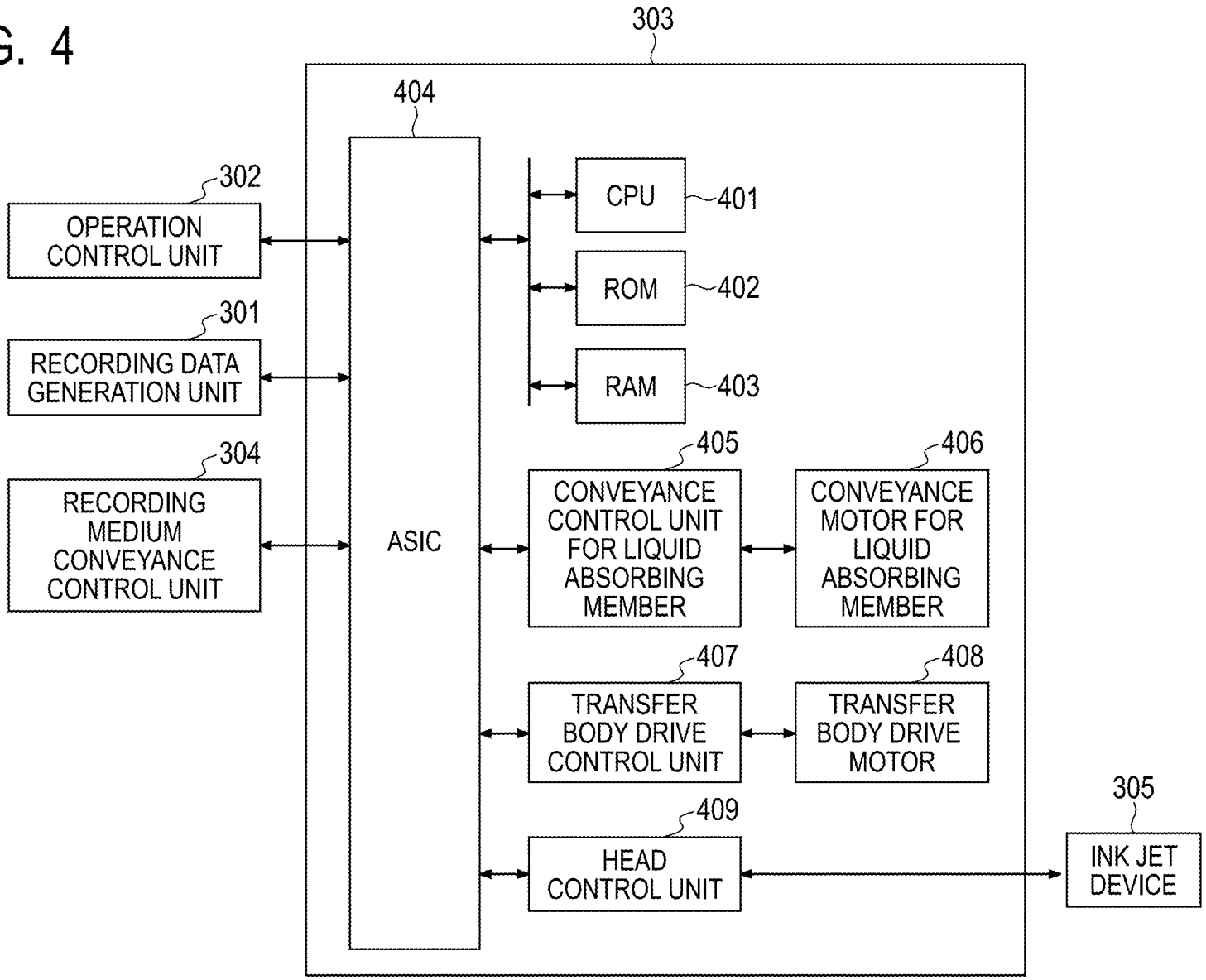
FIG. 4 is a block diagram of a printer control unit in the transfer type ink jet printing apparatus illustrated in FIG. 1.

FIG. 4 is a block diagram of the printer control unit in the transfer type ink jet printing apparatus illustrated in FIG. 1. 401 indicates a CPU that controls the entire printer, 402 indicates a ROM for storing a control program of the CPU, and 403 indicates a RAM for executing a program. 404 indicates an application specific integrated circuit (ASIC) including a network controller, a serial IF controller, a controller for head data generation, and a motor controller. 405 indicates a conveyance control unit for liquid absorbing member for driving a conveyance motor for liquid absorbing member 406, which is command-controlled from ASIC 404 via serial IF. 407 indicates a transfer body drive control unit for driving a transfer body drive motor 408, which is similarly command-controlled from ASIC 404 via serial IF. 409 indicates a head control unit that performs final discharge data generation, drive voltage generation of an ink jet device 305 and the like.

<Cleaning Device>

Figure 6:
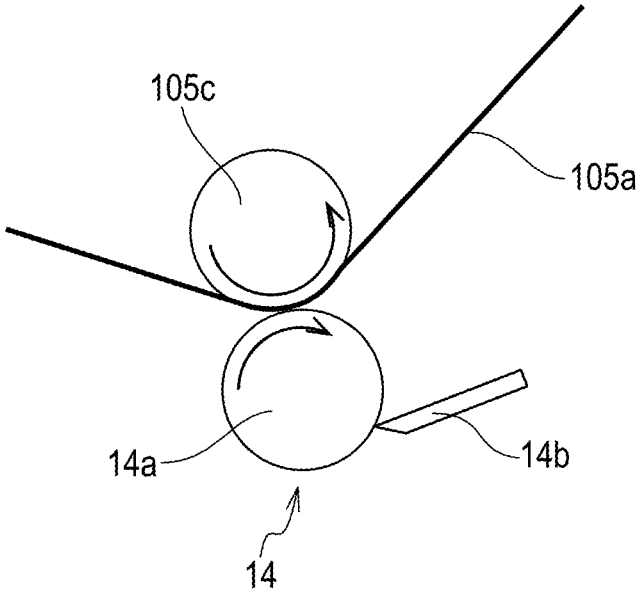
FIG. 6 is a schematic drawing illustrating an example of a cleaning device 14.

As illustrated in FIG. 1, the present embodiment has a cleaning device 14 for the liquid absorbing member. The cleaning device 14 removes an ink solid component, such as coloring materials and resin particles, adhering to the first surface of the liquid absorbing member by bringing a member 14*a* into contact with the first surface of the liquid absorbing member 105*a*. The cleaning device 14 includes a cleaning member 14*a*, and a cleaning blade 14*b* as illustrated in FIG. 6 additionally as necessary. The cleaning member 14*a* may use any material such as resin, metal, rubber as long as the cleaning member 14*a* has the capability of removing an ink solid component which has adhered to the first surface by coming into contact with the liquid absorbing member 105*a*. Although a roller shape is shown in FIG. 1, a configuration such as a web shape, a belt shape may be adopted. Although the cleaning member 14*a* is disposed to be opposed to an extending roller 105*c*, the cleaning device 14 having the cleaning member 14*a* may be disposed at any position between extending rollers.

<Liquid Collecting Device>

In the present embodiment, as illustrated in FIG. 1, a liquid collecting module 15 is used as a liquid collecting device. The liquid collecting module 15 blows pressurized air from the second surface (inner side) of the liquid absorbing member 105*a* by a pressurized gas ejection member such as an air knife 11 provided in a liquid collecting chamber 12, thus presses out the liquid component which has permeated the inside of the liquid absorbing member 105*a*, and blows away liquid droplets 13 (*b*) separated from the second surface of the porous body. The blown liquid droplets 13 (*b*) are stored as collection liquid 13 (*a*) at the bottom of the liquid collecting chamber 12. A backup roller 16 as illustrated in FIG. 1 is disposed on the first surface (surface) side of the liquid absorbing member 105*a* opposed to the liquid collecting module 15, and a pressurized gas is applied so that outward bulging of the liquid absorbing member 105*a* can be suppressed, and re-adhesion of the blown liquid droplets 13 (*b*) to the liquid absorbing member 105*a* can be prevented. The air knife 11 is provided inwardly of the liquid collecting chamber 12, and pressurized air is supplied by a pressurized air supply tube which is not illustrated. The air knife 11 is provided with a slit for blowing off air, the air blown through the slit is blown against the second surface of the liquid absorbing member 105*a*, and the liquid pressed out from the liquid absorbing member 105*a* is discharged, and flown as the liquid droplets 13 (*b*). The flown liquid droplets 13 (*b*) are kept inside the liquid collecting chamber 12, and are stored at the bottom as the collection liquid 13 (*a*). The stored collection liquid 13 (*a*) is discharged to the outside through a drain tube (not illustrated) or the like as needed. As illustrated, a configuration may be adopted in which the liquid pressed out from the second surface is flown as liquid droplets and collected, or a configuration may be adopted in which the liquid is once absorbed by an absorbing member such as a sponge, and is further squeezed out and collected. In order to store the collected liquid at the bottom of the liquid collecting chamber 12 without re-adhesion of the collected liquid to the liquid absorbing member 105*a*, the present embodiment has a configuration in which the air knife 11 is applied from below the liquid absorbing member 105*a*. Also, in order to obtain a favorable amount of liquid collection, as the manner of applying the air knife 11 to the liquid absorbing member 105*a*, a configuration is adopted in which a pressurized gas is applied in the counter direction rather than the forward direction with respect to the conveyance direction of the liquid absorbing member 105*a*, and the closest distance between the pressurized gas ejection member and the liquid absorbing member 105*a* is made shorter than or equal to 5 mm. Also, in the present invention, as a component, the liquid absorbing member 105*a* includes particularly, a porous body in a stacked layer structure having a first layer with a small pore diameter and a second layer with a large pore diameter, and thus even after collection of liquid by the air knife 11, the liquid is likely to remain within the absorption layers due to the meniscus force of the first layer, which is preferable. Since the liquid remains in the first layer, when the liquid absorbing member 105*a* is repeatedly used, the surface, to be brought into contact with an image, of the porous body already holds a liquid component containing the ink viscosity-increasing component.

(Direct Drawing Type Ink Jet Printing Apparatus)

Other embodiments in the present invention include a direct drawing type ink jet printing apparatus. In the direct drawing type ink jet printing apparatus, an ink receiving medium is a printing medium on which an image is to be formed.

Figure 2:
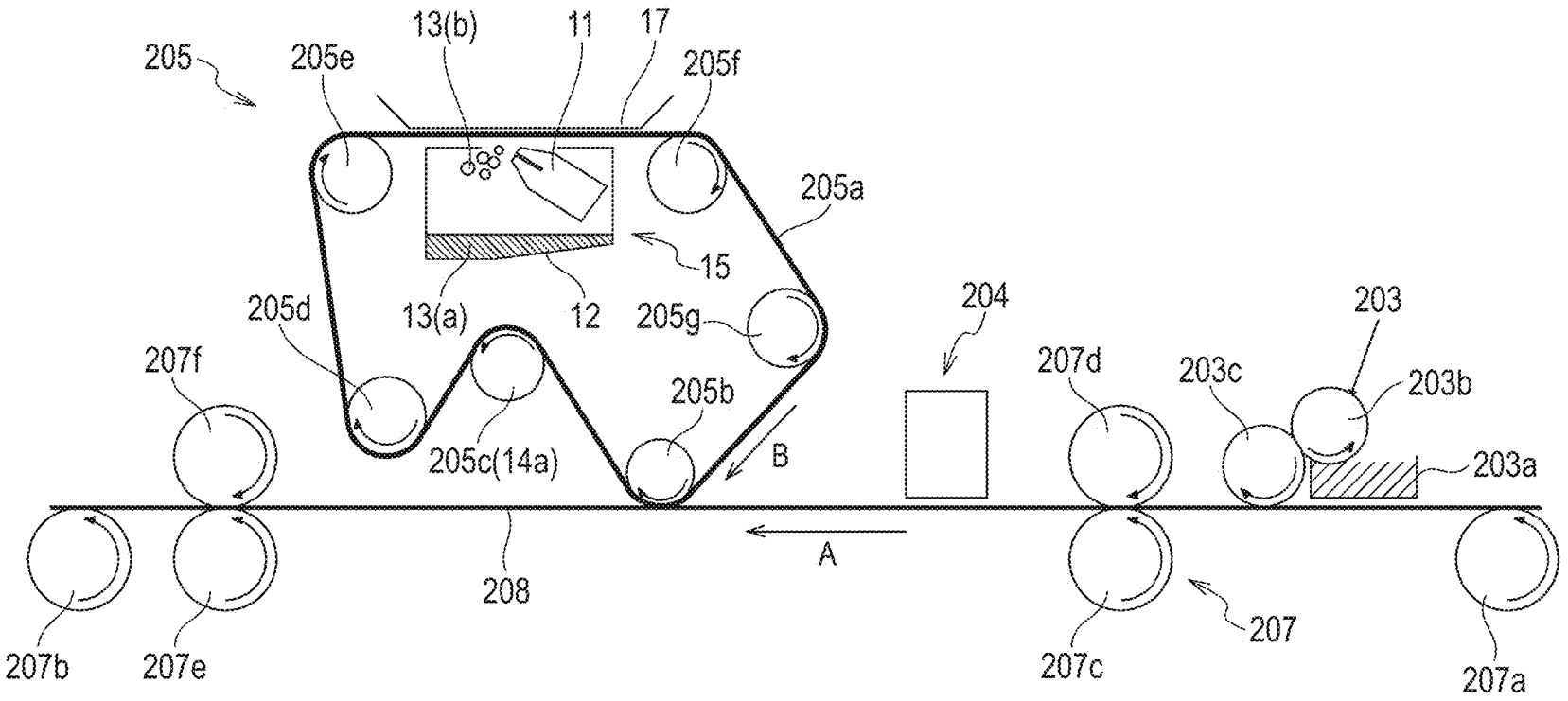
FIG. 2 is a schematic view illustrating an example of a configuration of a direct drawing type ink jet printing apparatus in an embodiment of the present invention.

FIG. 2 is a schematic view illustrating an example of a configuration of a direct drawing type ink jet printing apparatus 200 in the present embodiment. In contrast to the transfer type ink jet printing apparatus described above, the direct drawing type ink jet printing apparatus does not have the transfer body 101, the support member 102, the cleaning member for transfer body 109, and has the same means as that of the transfer type ink jet printing apparatus except for that an image is formed on a printing medium 208.

Therefore, because of a reaction liquid applying device 203 that applies reaction liquid to the printing medium 208, an ink applying device 204 that applies an ink to the printing medium 208, and a liquid absorbing member 205*a* in contact with the first image on the printing medium 208, a liquid absorbing device 205 that absorbs a liquid component contained in the first image has the same configuration as that of the transfer type ink jet printing apparatus, and a description is omitted.

It is to be noted that in the direct drawing type ink jet printing apparatus of the embodiment, the liquid absorbing device 205 has the liquid absorbing member 205*a*, and a pressing member 205*b* that presses the liquid absorbing member 205*a* against the first image on the printing medium 208. Also, the shapes of the liquid absorbing member 205*a* and the pressing member for liquid absorption 205*b* are not particularly restricted, and the liquid absorbing member 205*a* and the pressing member for liquid absorption 205*b* having the same shape as the shape of the liquid absorbing member and the pressing member usable by the transfer type ink jet printing apparatus may be used. Also, the liquid absorbing device 205 may have an extending member that extends over the liquid absorbing member. In FIGS. 2, 205*c*, 205*d*, 205*e*, 205*f*, and 205*g* indicate extending rollers as the extending member. The extending roller 205*c* is in contact with the first surface of liquid absorbing member 205*a*, and thus may also serve as the cleaning member 14*a*. The number of extending rollers is not limited to five in FIG. 2, and a necessary number of extending rollers may be disposed according to the design of the apparatus. Also, a printing unit that applies an ink to the printing medium 208 by the ink applying device 204, and a liquid component removal unit that brings the liquid absorbing member 205*a* into contact with the first image on the printing medium to remove a liquid component may have a printing medium support member which is not illustrated and supports the printing medium from below. Also, the liquid collecting device 15 of the present embodiment shows an example in which the support member 17 is disposed instead of a configuration having the backup roller 16 illustrated in FIG. 1.

<Printing Medium Conveying Device>

In the direct drawing type ink jet printing apparatus in the present embodiment, the printing medium conveying device 207 is not particularly limited, and a publicly known conveying device in the direct drawing type ink jet printing apparatus may be used. As illustrated in FIG. 2, examples include a printing medium conveying device having a printing medium feeding roller 207*a*, a printing medium winding roller 207*b*, and printing medium conveying rollers 207*c*, 207*d*, 207*e*, 207*f*.

<Control System>

The direct drawing type ink jet printing apparatus in the present embodiment has a control system that controls the devices. Similarly to the transfer type ink jet printing apparatus illustrated in FIG. 1, the block diagram illustrating the control system of the entire apparatus in the direct drawing type ink jet printing apparatus illustrated in FIG. 2 is as illustrated in FIG. 3.

Figure 5:
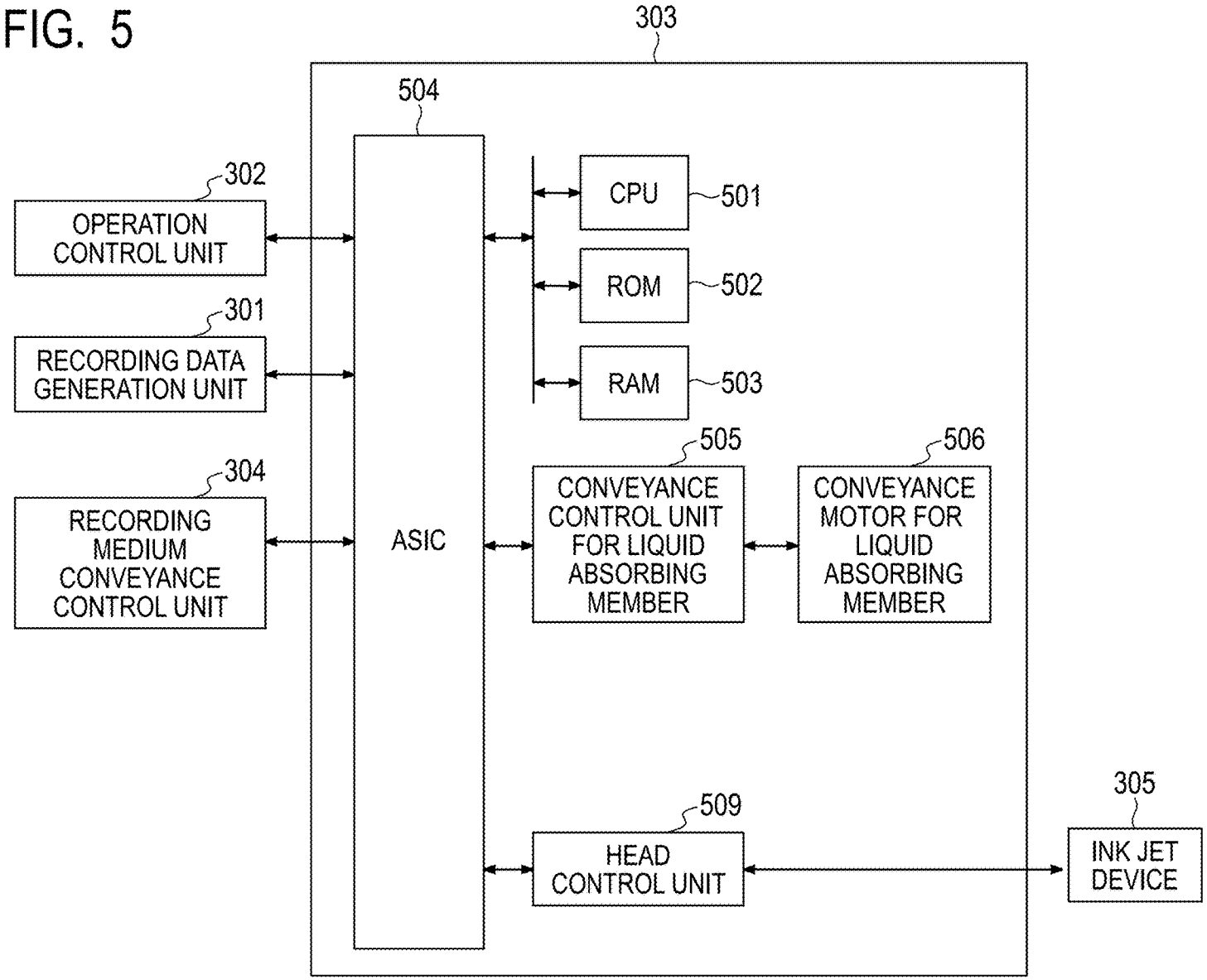
FIG. 5 is a block diagram of a printer control unit in the direct drawing type ink jet printing apparatus illustrated in FIG. 2.

FIG. 5 is a block diagram of a printer control unit in the direct drawing type ink jet printing apparatus illustrated in FIG. 2. The block diagram of FIG. 5 is the same as the block diagram of the printer control unit in the transfer type ink jet printing apparatus in FIG. 4 except for that the transfer body drive control unit 407 and the transfer body drive motor 408 are not provided. That is, 501 indicates a CPU that controls the entire printer, 502 indicates a ROM for storing a control program of the CPU, and 503 indicates a RAM for executing a program. 504 indicates an ASIC including a network controller, a serial IF controller, a controller for head data generation, and a motor controller. 505 indicates a conveyance control unit for liquid absorbing member for driving a conveyance motor for liquid absorbing member 506, which is command-controlled from ASIC 504 via serial IF. 509 indicates a head control unit that performs final discharge data generation, drive voltage generation of an ink jet device 305 and the like.

When the sequence illustrated in FIG. 11 is performed in a direct drawing type ink jet printing apparatus, a sheet having low absorbency may be used as the printing medium 208 to which reaction liquid is applied in PS1.

EXAMPLES

Hereinafter, the present invention will be described in detail using Examples and Comparative Examples. The present invention is not limited by Examples below unless departing from the gist of the invention. It is to be noted that in the description of Examples below, "Part" indicates a mass scale unless otherwise particularly stated.

Example 1

In this Example, the transfer type ink jet printing apparatus 100 illustrated in FIG. 1 is used.

As described above, the image formation on the printing medium in this Example is started with the reaction liquid application on the transfer body 101 supported by the support member 102, in the sequence illustrated in FIG. 10.

As described above, the reaction liquid applied at this point contains the ink viscosity-increasing component.

In this Example, PET sheet having a thickness of 0.5 mm is coated with silicone rubber (KE12 manufactured by Shin-Etsu Chemical Co., Ltd.) to obtain a sheet with a rubber thickness of 0.3 mm, and the sheet was used as the elastic layer of the transfer body. Furthermore, glycidoxypropyl trimethoxysilane and methyl triethoxysilane were mixed with a molar ratio 1:1, and a mixture of a condensation product obtained by heat reflux, and an optical cationic polymerization initiator (SP150 manufactured by ADEKA) was produced. The atmospheric pressure plasma treatment was performed so that the angle of contact of water on the surface of the elastic layer was 10 degrees or less. The mixture was applied onto the elastic layer, and film formation was performed by UV irradiation (high pressure mercury ramp, cumulative light exposure of 5000 mJ/cm$^2$), thermal curing (150° C. for 2 hours). The transfer body 101 with a surface layer having a thickness 0.5 μm was produced on the elastic layer.

In this configuration, illustration is omitted for simplified description.

A double-sided tape was used between the transfer body 101 and the support member 102 to hold the transfer body 101.

Also, in this configuration, the surface of the transfer body 101 was maintained at 60° C. by a heating device (not illustrated). Also, in the following Examples and Comparative Examples, for the amount of application of reaction liquid, the amount of application is changed by changing the reaction liquid applying members 103*b*, 103*c*.

The reaction liquid to be applied by the reaction liquid application device 103 in this Example had the following composition, and the application amount was 0.3 g/m$^2$.

Glutaric acid: 21.0 parts
Glycerin: 5.0 parts
Potassium hydrate: 0.9 parts
Surface-active agent (product name Megafac F444 manufactured by DIC Corporation): 5.0 parts
Ion-exchange water: the remaining parts When 0.3 g/m$^2$ of reaction liquid is applied in this Example, the molar quantity of the proton ions in the reaction liquid which serves as the ink viscosity-increasing component was approximately 0.9 mmol/m$^2$. As described above, subsequently, the ink applying device 104 applies an ink to the transfer body 101 with the reaction liquid applied thereto. The ink in this Example was prepared in the following manner.

<Preparation of Pigment Dispersion>

Carbon black (product name Monarch 1100, manufactured by Cabot Corporation), 10 parts, 15 parts of resin solution (styrene-ethyl acrylate-acrylic acid copolymer, acid value 150, weight average molecular weight (Mw) 8,000, solution having 20.0% by mass of resin component was neutralized by a potassium hydrate solution), and 75 parts of pure water were mixed, prepared in a batch type vertical sand mill (manufactured by IMEX Co., Ltd.), 200 parts of zirconia beads having a diameter of 0.3 mm were charged, and distributed processing performed for 5 hours while being cooled by water. The dispersion liquid was centrifuged to remove coarse particles, then black pigment dispersion having 10.0% by mass of pigment component was obtained.

<Preparation of Resin Particle Dispersion>

20 parts of ethyl methacrylate, 3 parts of 2,2'-azobis-(2-methylbutyronitrile), 2 parts of n-hexadecane were mixed, and agitated for 0.5 hours. The mixture was dropped into 75 parts of 8% solution of styrene-butyl acrylate-acrylic acid copolymer (acid value: 130 mgKOH/g, weight average molecular weight (Mw): 7,000), and the solution was agitated for 0.5 hours. Next, the solution was irradiated with ultrasonic waves by an ultrasonic irradiation device for 3 hours. Subsequently, polymerization reaction proceeded at 80° C. for 4 hours under a nitrogen atmosphere. After being cooled at a room temperature, the solution was filtered, and a resin particle dispersion having 25.0% by mass of resin component was prepared.

<Preparation of Ink>

The obtained resin particle dispersion and pigment dispersion were mixed with the components below. It is to be noted that the remaining parts of ion exchange water is such an amount that the total of all components constituting the ink is 100.0% by mass.

Pigment dispersion (content of coloring material is 10.0% by mass): 40.0% by mass
Resin particle dispersion: 20.0% by mass
Glycerin: 7.0% by mass
Polyethylene glycol (number average molecular weight (Mn): 1,000): 3.0% by mass
Surface-active agent: Acetyrenol E100 (manufactured by Kawaken Fine Chemicals Co., Ltd): 0.5% by mass
Ion exchange water: the remaining parts After the mixture was sufficiently agitated, and distributed, pressure filtration was performed by a micro filter (manufactured by Fujifilm Corporation) having a pore size of 3.0 μm, so that black ink was prepared.

The ink applying device 104 uses a type of inkjet head that discharges an ink on demand system using an electric-heat conversion element. A maximum application amount 26 g/m$^2$ of the prepared ink was applied onto the transfer body 101 to which the reaction liquid had been applied, and the first image was formed. At this point, the molar quantity of carboxylate ions in the ink which reacts with the proton ions in the reaction liquid, serving as the ink viscosity-increasing component was 0.6 mmol/m$^2$.

In this Example, the molar quantity of proton ions which contribute to increase in the ink viscosity in the reaction liquid applied for image formation was approximately 1.5 times the molar quantity of carboxylate ions in the ink, which contribute to increase the ink viscosity by reacting with the proton ions of the reaction liquid when a maximum application amount of ink is applied. Since both proton ions and carboxylate ions are monovalent, the molar equivalent ($H^+/COO^-$) was also approximately 1.5.

Next, the liquid absorbing member 105*a* was brought into contact with the first image formed on the transfer body 101 by the ink applying device 104, and excessive liquid in the first image was absorbed by the liquid absorbing member 105*a*.

The liquid absorbing member 105*a* is adjusted to have the same speed as the movement speed of the transfer body 101 by conveyance motors for liquid absorbing member 105*c*, 105*d*, 105*e*. Similarly, the printing medium 108 is conveyed by the printing medium feeding roller 107*a* and the printing medium winding roller 107*b* so that the printing medium 108 has the same speed as the movement speed of the transfer body 101.

The liquid absorbing member 105*a* in this Example 1 used a belt which had a porous PTFE as a porous body, the porous PTFE having an average pore diameter of 3 μm and a thickness of 100 μm.

With this configuration, the liquid absorbing member 105*a* is brought into contact with the first image formed on the transfer body 101, and the liquid in the first image was absorbed. A pressure was applied to the pressing member

105*b* so that the average pressure of the nip pressure between the transfer body 101 and the liquid absorbing member 105*a* achieves 9.8 N/cm$^2$ (1 kg/cm$^2$). Subsequently, the second image with reduced liquid component was transferred to the printing medium 108. In this Example, Aurora Coated paper (manufactured by Nippon Paper Industries Co., Ltd., basis weight of 104 g/m$^2$) was used as the printing medium 108.

Meanwhile, in the liquid absorbing member 105*a* having absorbed liquid, an adhering material, such as a coloring material, which adheres to the contact surface (the first surface) with the first image was removed by a cleaning roller 14*a* opposed to the conveyance motor for liquid absorbing member 105*c*. The cleaning roller 14*a* was brought into contact with the liquid absorbing member 105*a* with 9.8 N/cm$^2$ (1 kg/cm') using EPDM rubber having a rubber hardness of 40°. Also, as illustrated in FIG. 6, the cleaning device 14 scraped off an adhering material which adheres to the cleaning roller 14*a* by the cleaning blade 14*b*.

Subsequently, the liquid component which had permeated the inside of the liquid absorbing member 105*a* was blown away as the liquid droplets 13 (*b*) by blowing pressurized air from the second surface opposed to the first surface of the liquid absorbing member 105*a* by the air knife 11 provided in the liquid collecting chamber 12, and the liquid component was collected as the collection liquid 13 (*a*) in the liquid collecting chamber 12. At this point, the liquid component was collected by controlling an air pressure so that part of the liquid component remains in the porous body of the liquid absorbing member 105*a*.

Repetitive operation of the cycle of the reaction liquid application, the ink application, the liquid absorption, the cleaning, and the liquid collection was performed under the above-mentioned conditions. One rotation of the belt-shaped liquid absorbing member 105*a* was counted as one time.

Example 2

The cycle was repeatedly performed similarly to Example 1 except that the porous body of the liquid absorbing member 105*a* in Example 1 was replaced by a porous body having a two-layer configuration. The porous body includes two layers in which the first layer is PTFE having an average pore diameter of 0.2 μm and a thickness of 25 μm, and the second layer is non-woven fabric having an average pore diameter of 15 μm and a thickness of 100 μm, and the first layer served as the surface (the first surface) of the liquid absorbing member 105*a*, and was brought into contact with the first image on the transfer body.

Example 3

In Example 1, the printing sequence was changed to a sequence in which the reaction liquid filling sequence of PS1, PS2 illustrated in FIG. 11 is first performed.

Example 4

For Example 1, the amount of application of reaction liquid was changed to 0.5 g/m$^2$. The molar quantity of proton ions in the reaction liquid in this case was approximately 1.4 mmol/m$^2$ which was approximately 2.4 times the molar quantity of carboxylate ions which contribute to increase the ink viscosity in the ink when a maximum application amount of the ink is applied.

Example 5

For Example 2, the amount of application of reaction liquid was changed to 0.5 g/m$^2$. The molar quantity of proton ions in the reaction liquid in this case was approximately 1.4 mmol/m$^2$ which was approximately 2.4 times the molar quantity of carboxylate ions which contribute to increase the ink viscosity in the ink when a maximum application amount of the ink is applied.

Comparative Example 1

For Example 1, the amount of application of reaction liquid was changed to 0.15 g/m$^2$. The molar quantity of proton ions in the reaction liquid in this case was approximately 0.4 mmol/m$^2$ which was approximately 0.7 times the molar quantity of carboxylate ions which contribute to increase the ink viscosity in the ink when a maximum application amount of ink is applied.

Comparative Example 2

For Comparative Example 1, a unit to perform ultrasonic cleaning with an alkaline detergent was used as a cleaning unit.

Comparative Example 3

For Example 1, for each liquid collection, a state was achieved where the liquid does not remain nearly completely in the liquid absorbing member 105*a* by adjustment of the pressure of the air knife.

Evaluation was made by the following evaluation technique under the above-described conditions for Examples 1 to 5, Comparative Examples 1 to 3. An evaluation result is shown in Table 1. For the evaluation items mentioned below, evaluation codes AA to B indicate an acceptable level, and C indicates an unacceptable level.

<Liquid Absorption Performance>

For the liquid absorption performance, curl of the printing medium 108 after transfer was visually checked and evaluated.

AA: even when evaluation was repeatedly performed 10000 times, deterioration of the liquid absorption performance was not observed.

A: even when evaluation was repeatedly performed 1000 times, deterioration of the liquid absorption performance was not observed.

B: when evaluation was repeatedly performed 1000 times, slight deterioration of the liquid absorption performance was observed, however, the liquid absorption performance was at a practically satisfactory level.

C: when evaluation was repeatedly performed 1000 times, significant deterioration of the liquid absorption performance was observed, and a practical problem occurred.

<Durability of Liquid Absorbing Member>

For the durability of the liquid absorbing member, the state of the surface of the liquid absorbing member after durability was visually checked and evaluated.

B: when evaluation was repeatedly performed 1000 times, even if damage occurred, the damage was extremely small and was not at a practically problematic level.

C: when evaluation was repeatedly performed 1000 times, certain damage was observed occasionally at a visual level

TABLE 1

| | Reaction liquid | | | | Liquid absorbing member | | | | | |
|---|---|---|---|---|---|---|---|---|---|---|
| | | | | | First layer | | Second layer | | | Remaining liquid |
| | Application amount g/m$^2$ | $H^+$ ion mmol/m$^2$ | Molar equivalent ratio | Pre-application | Material | Average pore diameter | material | Average pore diameter | Cleaning | after liquid collection |
| Example 1 | 0.3 | 0.9 | approx. 1.5 | not provided | PTFE | 3 μm | | | EPDM rubber | Present |
| Example 2 | 0.3 | 0.9 | approx. 1.5 | not provided | PTFE | 0.2 μm | non-woven fabric | 15 μm | EPDM rubber | Present |
| Example 3 | 0.3 | 0.9 | approx. 1.5 | Provided | PTFE | 3 μm | | | EPDM rubber | Present |
| Example 4 | 0.5 | 1.4 | approx. 2.4 | not provided | PTFE | 3 μm | | | EPDM rubber | Present |
| Example 5 | 0.5 | 1.4 | approx. 2.4 | not provided | PTFE | 0.2 μm | non-woven fabric | 15 μm | EPDM rubber | Present |
| Comparative example 1 | 0.15 | 0.4 | approx. 0.7 | not provided | PTFE | 3 μm | | | EPDM rubber | Present |
| Comparative example 2 | 0.15 | 0.4 | approx. 0.7 | not provided | PTFE | 3 μm | | | Ultrasonic cleaning | Present |
| Comparative example 3 | 0.3 | 0.9 | approx. 1.5 | not provided | PTFE | 3 μm | | | EPDM rubber | Absent |

| | Liquid absorption performance | Durability |
|---|---|---|
| Example 1 | B | B |
| Example 2 | A | B |
| Example 3 | A | B |
| Example 4 | A | B |
| Example 5 | AA | B |
| Comparative example 1 | C | B |
| Comparative example 2 | B | C |
| Comparative example 3 | C | B |

According to an embodiment of the present invention, ink solid component can be kept on the surface of a porous body, and thus the probability of intrusion of the ink solid component into the inside of the porous body can be reduced. Consequently, the ink solid component on the surface of the porous body can be removed by a cleaning method which has a less effect on the porous body, and the porous body can maintain the liquid absorption performance and improve the durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet printing method comprising:

a step of applying a reaction liquid to an ink receiving medium, the reaction liquid containing an ink viscosity-increasing component that increases a viscosity of an ink;

a step of forming a first image by applying the ink to the ink receiving medium with the reaction liquid applied thereto;

a step of bringing a liquid absorbing member having a porous body made of a porous material into contact with the first image, and absorbing liquid from the first image by the porous body;

a step of bringing a cleaning member into contact with a first surface of the porous body, to be brought into contact with the first image, and cleaning the first surface; and a step of bringing the liquid absorbing member having the porous body, which was cleaned by the step of bringing the cleaning member into contact with the first surface of the porous body, into contact with the first image, and absorbing liquid from the first image by the porous body, wherein the printing method further comprises, before the step of applying the reaction liquid to the ink receiving medium, a step of applying the reaction liquid onto the porous body without applying the ink to the porous body.

2. The printing method according to claim 1, wherein in the step of applying the reaction liquid to the ink receiving medium, the reaction liquid is applied in an amount more than necessary to increase the viscosity of a maximum amount of the ink applied in the step of forming a first image.

3. The printing method according to claim 2, wherein a molar equivalent of a first chemical species in the reaction liquid applied in the step of applying the reaction liquid to the ink receiving medium is two or more times greater than a molar equivalent of a second chemical species in the maximum amount of the ink applied in the step of forming a first image, and wherein the first chemical species contributes to a reaction of the ink viscosity-increasing component, and the second chemical species in the ink reacts with the ink viscosity-increasing component.

4. The printing method according to claim 1, wherein the step of applying the reaction liquid is performed before a first cycle after the liquid absorbing member is replaced.

5. The printing method according to claim 1, wherein in the porous body, an average surface pore diameter on the first surface is smaller than an average surface pore diameter on a second surface opposed to the first surface.

6. The printing method according to claim 5, wherein the porous body is in a stacked layer structure including a first layer having a first average pore diameter, and a second layer having a second average pore diameter greater than the first average pore diameter, wherein the first layer constitutes the first surface, and wherein the second layer constitutes the second surface.

7. The printing method according to claim 1, further comprising a step of collecting the liquid absorbed by the porous body, which is performed for each cycle of the step of applying the reaction liquid to the ink receiving medium, the step of forming the first image, the step of bringing the liquid absorbing member into contact with the first image, and the step of bringing the cleaning member into contact with the first surface of the porous body.

8. The printing method according to claim 1, wherein the ink receiving medium is a transfer body that temporarily holds the first image and a second image in which the liquid is absorbed from the first image, and wherein the printing method includes a step of transferring the second image onto a printing medium and forming a third image.

9. The printing method according to claim 1, wherein the ink receiving medium is a printing medium on which an image is to be formed.

10. A printing apparatus comprising:

a reaction liquid applying unit that applies a reaction liquid to an ink receiving medium, the reaction liquid containing an ink viscosity-increasing component that increases a viscosity of an ink;

a forming unit that forms a first image by applying the ink to the ink receiving medium with the reaction liquid applied thereto;

a liquid absorbing unit that brings a liquid absorbing member having a porous body made of a porous material into contact with the first image, and absorbs liquid from the first image by the porous body;

a cleaning unit that brings a cleaning member into contact with a first surface of the porous body, to be brought into contact with the first image, and cleans the first surface; and a controller configured to control the reaction liquid applying unit and the forming unit such that before application of the reaction liquid to the ink receiving medium, the reaction liquid applying unit applies the reaction liquid onto the porous body without applying the ink from the forming unit to the porous body.

11. The printing apparatus according to claim 10, wherein the reaction liquid applying unit applies the reaction liquid in an amount more than necessary to increase the viscosity of a maximum amount of the ink applied by the forming unit.

12. The printing apparatus according to claim 11, wherein the reaction liquid applying unit applies the reaction liquid such that a molar equivalent of a first chemical species in the reaction liquid is two or more times greater than a molar equivalent of a second chemical species in the maximum amount of the ink applied by the forming unit, and wherein the first chemical species contributes to a reaction of the ink viscosity-increasing component, and the second chemical species in the ink reacts with the ink viscosity-increasing component.

13. The printing apparatus according to claim 10, wherein the controller is configured to control the apparatus so as to apply the reaction liquid to the porous body through the first surface of the porous body when the printing apparatus does not print an image.

14. The printing apparatus according to claim 13, wherein the controller is configured to control the apparatus such that before a start of printing images, the reaction liquid applying unit applies the reaction liquid onto the ink receiving medium without ink application by the forming unit and the liquid absorbing unit brings the porous body into contact with the reaction liquid on the ink receiving medium.

15. The printing apparatus according to claim 13, wherein the controller is configured to control the apparatus such that before a start of printing images after the liquid absorbing member is replaced, the reaction liquid applying unit applies the reaction liquid onto the ink receiving medium and the porous body is brought into contact with the reaction liquid only.

16. A printing method with the use of an ink jet printing apparatus comprising:

a transfer body;

a reaction liquid applying unit that applies a reaction liquid to the transfer body, the reaction liquid containing an ink viscosity-increasing component that increases a viscosity of an ink;

a forming unit that forms an ink image by applying the ink to the transfer body with the reaction liquid applied thereto;

a liquid absorbing unit provided with a liquid absorbing member including a porous body made of a porous material and having a first surface, the liquid absorbing unit bringing the first surface of the porous body into contact with the ink image on the transfer body to absorb liquid from the ink image by the porous body;

a transfer unit that transfers the ink image to a printing medium after the liquid is absorbed from the ink image by the porous body; and a cleaning unit that brings a cleaning member into contact with the first surface of the porous body to clean the first surface, the method comprising:

controlling the reaction liquid applying unit, the forming unit, and the transfer unit such that the reaction liquid is applied to the first surface of the porous body without ink application to the first surface by the forming unit in advance of bringing the first surface of the porous body into contact with the ink image that is going to be transferred to the printing medium; and controlling the transfer body and the liquid absorbing unit such that the liquid absorbing member absorbs the reaction liquid applied on the first surface through the first surface.

17. The printing method according to claim 16, wherein the reaction liquid is applied to the first surface of the porous body in advance of bringing the first surface of the porous body is brought into contact with the ink image that is going to be transferred to the printing medium.

18. The printing method according to claim 17, wherein the application of the ink viscosity-increasing component to the first surface of the porous body in advance of bringing the first surface of the porous body into contact with the ink image that is going to be transferred to the printing medium is performed by applying the reaction liquid onto the transfer body by the reaction liquid applying unit and allowing the reaction liquid applied onto the transfer body to be absorbed by the porous body in advance of forming the ink image on the transfer body by the forming unit.

19. The printing method according to claim 17, wherein the application of the ink viscosity-increasing component to the first surface of the porous body in advance of bringing the first surface of the porous body into contact with the ink image that is going to be transferred to the printing medium is performed by applying the reaction liquid onto the transfer body by the reaction liquid applying unit without applying the ink onto the transfer body and allowing the reaction liquid applied onto the transfer body to be absorbed by the porous body.

20. The printing method according to claim 16, wherein the forming unit is configured to eject an ink containing a coloring material to the transfer body with the reaction liquid applied thereto and then eject a clear ink containing no coloring material onto the ink containing a coloring material on the transfer body to form the ink image on the transfer body.

21. An ink jet printing apparatus comprising:

a transfer body;

a reaction liquid applying unit that applies a reaction liquid to the transfer body, the reaction liquid containing an ink viscosity-increasing component that increases a viscosity of an ink;

a forming unit that forms an ink image by applying the ink to the transfer body with the reaction liquid applied thereto;

a liquid absorbing unit provided with a liquid absorbing member including a porous body made of a porous material and having a first surface, the liquid absorbing unit bringing the first surface of the porous body into contact with the ink image on the transfer body to absorb liquid from the ink image by the porous body;

a transfer unit that transfers the ink image to a printing medium after the liquid is absorbed from the ink image by the porous body;

a cleaning unit that brings a cleaning member into contact with the first surface of the porous body to clean the first surface; and a controlling unit configured to:

control the reaction liquid applying unit, the forming unit, and the transfer unit such that the reaction liquid is applied to the first surface of the porous body without ink application to the first surface by the forming unit in advance of bringing the first surface of the porous body into contact with the ink image that is going to be transferred to the printing medium; and control the transfer body and the liquid absorbing unit such that the liquid absorbing member absorbs the reaction liquid applied on the first surface through the first surface.

22. The ink jet printing apparatus according to claim 21, wherein the controller is configured to apply the ink viscosity-increasing component to the first surface of the porous body in advance of bringing the first surface of the porous body into contact with the ink image that is going to be transferred to the printing medium, and wherein the controller is configured to control the apparatus such that the reaction liquid is applied onto the transfer body by the reaction liquid applying unit while the ink is not applied onto the transfer body by the forming unit and the reaction liquid applied onto the transfer body is absorbed by the porous body.

* * * * *